US008393609B2

(12) United States Patent
Karasawa et al.

(10) Patent No.: US 8,393,609 B2
(45) Date of Patent: Mar. 12, 2013

(54) DOCUMENT HANDLER

(75) Inventors: Shigeyuki Karasawa, Tokyo (JP); Tomonori Kitano, Osaka (JP)

(73) Assignee: Japan Cash Machine Co., Ltd., Osaka (JP)

( * ) Notice: Subject to any disclaimer, the term of this patent is extended or adjusted under 35 U.S.C. 154(b) by 0 days.

(21) Appl. No.: 13/147,269

(22) PCT Filed: Feb. 2, 2010

(86) PCT No.: PCT/JP2010/000619

§ 371 (c)(1),
(2), (4) Date: Oct. 14, 2011

(87) PCT Pub. No.: WO2010/087212

PCT Pub. Date: Aug. 5, 2010

(65) Prior Publication Data

US 2012/0038099 A1 Feb. 16, 2012

(30) Foreign Application Priority Data

Feb. 2, 2009 (JP) ..... 2009-22071

(51) Int. Cl.
*B65H 5/22* (2006.01)
*B65H 29/38* (2006.01)

(52) U.S. Cl. ..... 271/3.01; 271/3.08; 271/177; 271/180

(58) Field of Classification Search ..... 271/3.01, 271/3.08, 177, 180, 181; 209/534; 902/12
See application file for complete search history.

(56) References Cited

U.S. PATENT DOCUMENTS

| | | | | |
|---|---|---|---|---|
| 5,271,613 | A | 12/1993 | Hain | |
| 6,824,046 | B2 | 11/2004 | Brexel et al. | |
| 7,322,518 | B2 | 1/2008 | Yokoi et al. | |
| 2004/0079683 | A1 | 4/2004 | Utz et al. | |
| 2008/0038038 | A1 * | 2/2008 | Arai et al. | 400/582 |

FOREIGN PATENT DOCUMENTS

| | | | |
|---|---|---|---|
| DE | 4005291 | A1 | 8/1990 |
| EP | 1603085 | A1 | 12/2005 |
| JP | 4-158494 | | 6/1992 |
| JP | 9-259342 | | 10/1997 |
| JP | 11-213207 | | 8/1999 |
| JP | 11-339100 | | 12/1999 |
| JP | 2003-346210 | | 12/2003 |
| WO | 0154078 | A2 | 7/2001 |

OTHER PUBLICATIONS

European Search Report for EP 10735682.6, dated Jul. 18, 2012.

* cited by examiner

*Primary Examiner* — David H Bollinger
(74) *Attorney, Agent, or Firm* — Bachman & LaPointe, P.C.

(57) ABSTRACT

A document handler is provided that comprises a validator 2 having a main conveyor 4, a stacker 3 having a storage 50 detachably attached to validator 2, a storage conveyor 5 in storage 50 for stowing a document fed from validator 2 into storage 50 and picking out the document stored in storage 50 to validator 2 through main conveyor 4 to issue picked document from validator 2, a reversible motor 70 in main conveyor 4 drivingly and detachably connected to storage conveyor 5 of storage 50.

13 Claims, 20 Drawing Sheets

DOCUMENT HANDLER

TECHNICAL FIELD

This invention relates to a document handler that comprises a validator and a stacker provided with a storage detachably attached to the validator to store documents in the storage, discharge the stored documents from the storage and dispense them from the validator.

BACKGROUND OF THE INVENTION

Patent Document 1 below listed discloses an automated teller machine that comprises a front operation panel for depositing into and dispensing bills out of the teller machine, a plurality of small validators for validating authenticity, denomination and defacement of bills and counting bills, a plurality of cashboxes for storing a number of bills, a reject safe for collecting defaced, rejected or non-recyclable bills or etc., a plurality of escrow reservations for temporarily accumulating bills therein upon the reception, stowing the bills into the cashboxes and picking out bills of the designated amount from the cashboxes upon the payment, and serial passageways for transporting bills one by one among the front operation panel, small validators, cashboxes, reject safe and escrow reservations, wherein the serial passageways comprise a bidirectional path for transporting bills guided along the bidirectional path in the forward and adverse directions and a plurality of unidirectional paths for transporting bills guided along the unidirectional path in a single direction. This automated teller machine however is disadvantageous because it requires a larger size and a complicated structure in the paths that connect cashboxes and reject safe to bidirectional path through unidirectional paths. Also, it is inconvenient because cashboxes and reject safe cannot be removed from the machine for collection of bills therein.

Then, Patent Document 2 teaches a bill storage that comprises a plurality of stackers for bills of different denominations and a bill conveyor for transporting bills into and out of stackers along a channel for guiding bills. Bill conveyor has a door that may be opened and closed by rotating the door about a pivot provided at one end of the channel so that the door is closed to form the channel, and it is opened to approach from outside a space for forming the channel. However, this bill storage undesirably has the bill conveyor of its complicated structure that interferes downsizing of the storage and also inconveniently precludes removable attachment of any stacker to the storage.

PRIOR ART DOCUMENTS

[Patent Document 1] Japanese Patent Disclosure No. 4-158494, FIG. 1

[Patent Document 2] Japanese Patent Disclosure No. 11-339100, FIGS. 1, 8, 28, 46 and 47

SUMMARY OF THE INVENTION

Problem to be Solved by the Invention

An object of the present invention is to provide a document handler that comprises a validator and a stacker provided with a storage removably attached to the validator to stow in the storage documents inserted into and transported from the validator and also to dispense the documents in the storage.

Another object of the present invention is to provide a small-sized document handler equipped with a light-weight stacker.

Means for Solving the Problem

The document handler according to the present invention, comprises a validator (2), a stacker (3) provided with a storage (50) removably attached to validator (2), and a main conveyor (4) attached to validator (2) for transporting a document along a main passageway (6) formed between validator (2) and stacker (3). Stacker (3) also comprises a storage conveyor (5) for stowing into storage (50) documents supplied from validator (2) through main conveyor (4) and also for extracting one by one documents stored in storage (50). Main conveyor (4) comprises a reversible motor (70) for driving storage conveyor (5) in stacker (3) in the selected direction. Storage (50) may be removed from validator (2) along main passageway (6) by releasing the driving connection between storage conveyor (5) and reversible motor (70).

Storage conveyor (5) may serve a dual function of firstly stowing into stacker (3) documents one by one supplied from validator (2) and secondly picking out of storage (50) documents one by one to transport them to validator (2) by means of main conveyor (4) for dispensation of documents from validator (2). Here, storage conveyor (5) is drivingly and separably connected to reversible motor (70) that may drive storage conveyor (5) so that stacker (3) may save the need of or dispense with any drive source and may therefore be produced in light-weight. When storage (50) is attached to validator (2), storage conveyor (5) in stacker (3) is automatically brought into driving connection to reversible motor (70) in main conveyor (4) to operate storage conveyor (5) systematically and organically or in conjunction with operation of main conveyor (4). Also, as storage (50) is detachably attached to validator (2), it may be separated from validator (2) to collect storage (50) for collection and counting of documents in storage (50). In addition, after storage (50) is extracted forward of and removed from validator (2), an operator may access main conveyor (4) for its easy maintenance, inspection and repair after removal of storage (50).

Effect of the Invention

The present invention can provide a lightweight, small-sized and highly reliable document handler of the simplified mechanism that comprises a validator and a storage that may be drawn out and removed ahead of the validator for its easy maintenance and management.

EXPLANATION OF SYMBOLS (1) . . . a bill validating/stacking/dispensing device (a document handler), (2) . . . a validator, (3) . . . a stacker, (4) . . . a main conveyor, (5) . . . a storage conveyor, (6) . . . a main passageway, (10) . . . a validation sensor, (20) . . . an inlet, (21) . . . an outlet, (21*a*) . . . a passage sensor, (22) . . . a validation conveyor, (22*a*) . . . a validation passageway, (22*b*) . . . conveyor belts, (22*c*) . . . pulleys, (22*d*) . . . idle rollers, (23) . . . a conveyor motor, (24) . . . a stack motor, (24*a*) . . . a gear, (26) . . . an outlet gear, (30) . . . a casing, (31) . . . a first stacker, (32) . . . a second stacker, (33, 33*a*, 33*b*) . . . feed rollers, (33*c*, 33*d*) . . . idle rollers, (34, 34*a*, 34*b*) . . . delivery rollers, (35*a*, 35*b*) . . . follower gears, (36*a*, 36*b*) . . . fourth gears, (38) . . . deflection levers, (38*a*) . . . an upper deflection lever (a first deflection lever), (38*b*) . . . a lower deflection lever (a second deflection lever), (38*e*) . . . a lever upper end, (38*f*) . . . a lever lower end, (39) . . . a lever, (39*a*) . . . a cutout, (39*b*) . . . a handle, (40) . . . a main conveyor belt, (41, 43, 44, 45) . . . pulleys, (42) . . . a driven gear, (46, 47, 48) . . . idle rollers, (49, 49*a*, 49*b*) . . . pinch rollers, (50) . . . a storage, (51) . . . a container, (55, 55*a*, 55*b*) . . . bottom plates, (56, 56*a*, 56*b*) . . . pusher plates, (57, 57*a*, 57*b*) . . . support plates, (58) . . . a roller, (59*a*, 59*b*) . . . springs, (60) . . . a first gear train (a first power transmission), (61, 62, 63, 64, 65) . . . gears, (66, 67) . . . pulleys, (68) . . . a belt, (69) . . . a second gear train (a second power transmission), (70) . . . reversible motors, (70*a*) . . . an upper reversible motor, (70*b*) . . . a lower reversible motor, (71*a*, 71*b*) . . . pinions, (72*a*, 72*b*, 74*a*, 74*b*, 75*a*, 75*b*) . . . gears, (76, 76*a*, 76*b*) . . . drive gears, (80) . . . a lifter motor, (81) . . . a lift cam, (81*a*) . . . a lift cam pin, (82) . . . a lift lever, (82*a*) . . . a lift lever pin, (82*b*) . . . a hollow, (82*c*) . . . a long opening, (83) . . . a rod, (83*a*) . . . a pin, (83*b*) . . . a notch, (90) . . . a pin, (180) . . . a lifter, (251) . . . an upper solenoid (a first actuator), (252) . . . a lower solenoid (a second actuator), (255) . . . an upper lever roller, (256) . . . a lower lever roller,

BEST MODE FOR CARRYING OUT THE INVENTION

Embodiments will be described hereinafter regarding the document handler according to the present invention applied to a bill validating/stacking/dispensing device with reference to FIGS. 1 to 22 of the drawings wherein same reference symbols denote same portions in the device.

Figure 1:
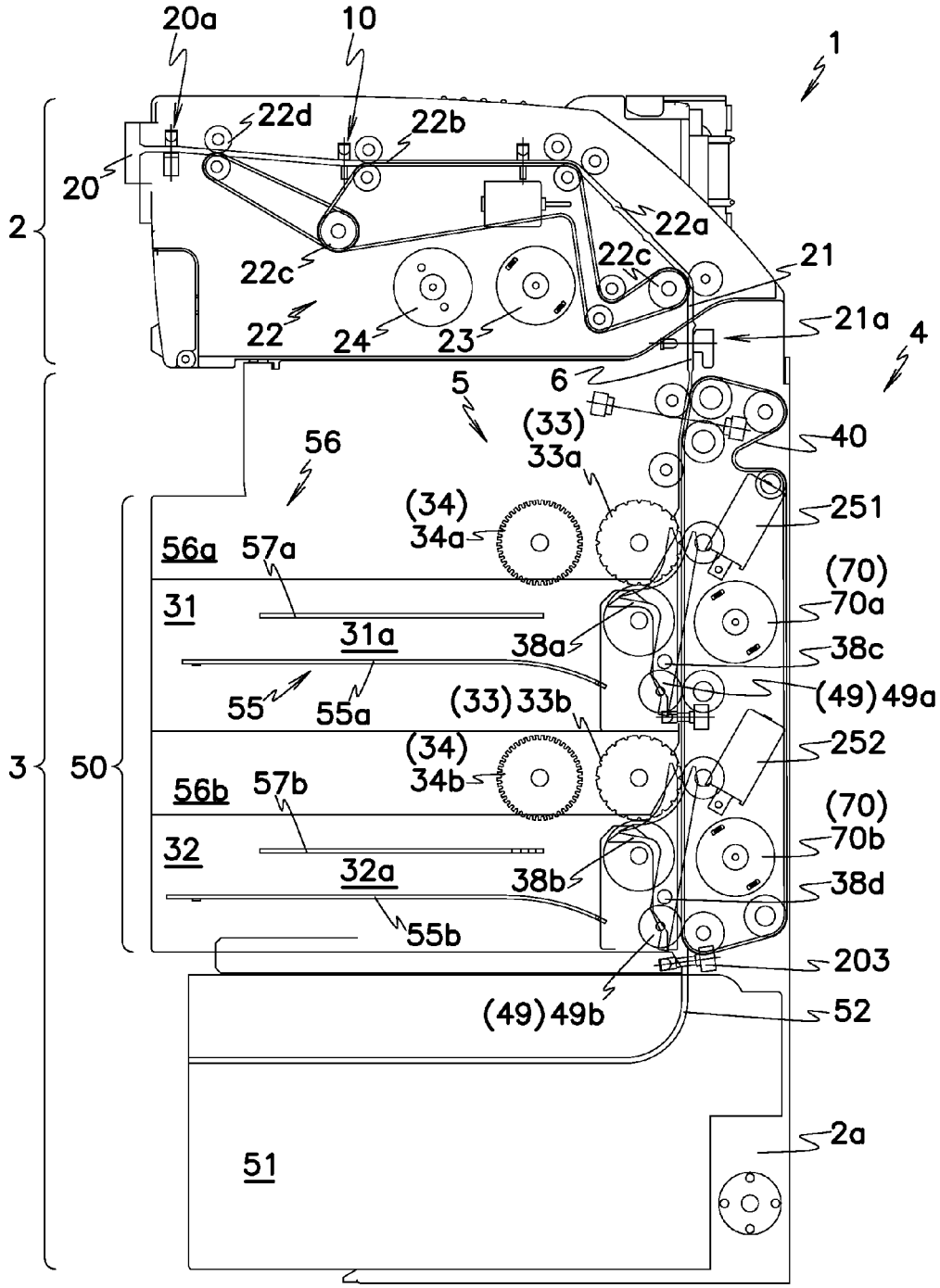
FIG. 1 A section view showing an embodiment of the document handler according to the present invention applied to a bill validating/stacking/dispensing device.

FIG. 1 shows an embodiment of the bill validating/stacking/dispensing device according to the present invention that comprises a validator 2 having a frame 2*a*, a stacker 3 having a storage 50 and a container 51, and a main conveyor 4 secured to frame 2*a* of validator 2 for transporting bills along a main passageway 6 formed between validator 2 and storage 50 of stacker 3. Storage 50 comprises upper and lower stackers 31 and 32 having respectively upper and lower (first and second) storage spaces 31*a* and 32*a*, and storage 50 itself may be removably attached to frame 2*a* of validator 2. The embodiment of the present invention contemplates that stacker 3 comprises storage 50 for storing bills in the extractable fashion, and a single or a plurality of storage conveyors 5 for stowing into storage 50 bills supplied from validator 2 through main conveyor 4 and also for extracting bills stored in storage 50, and also contemplates that main conveyor 4 comprises a reversible motor or motors 70 to which storage conveyors 5 in stacker 3 may be in detachable and driving connection.

Figure 4:
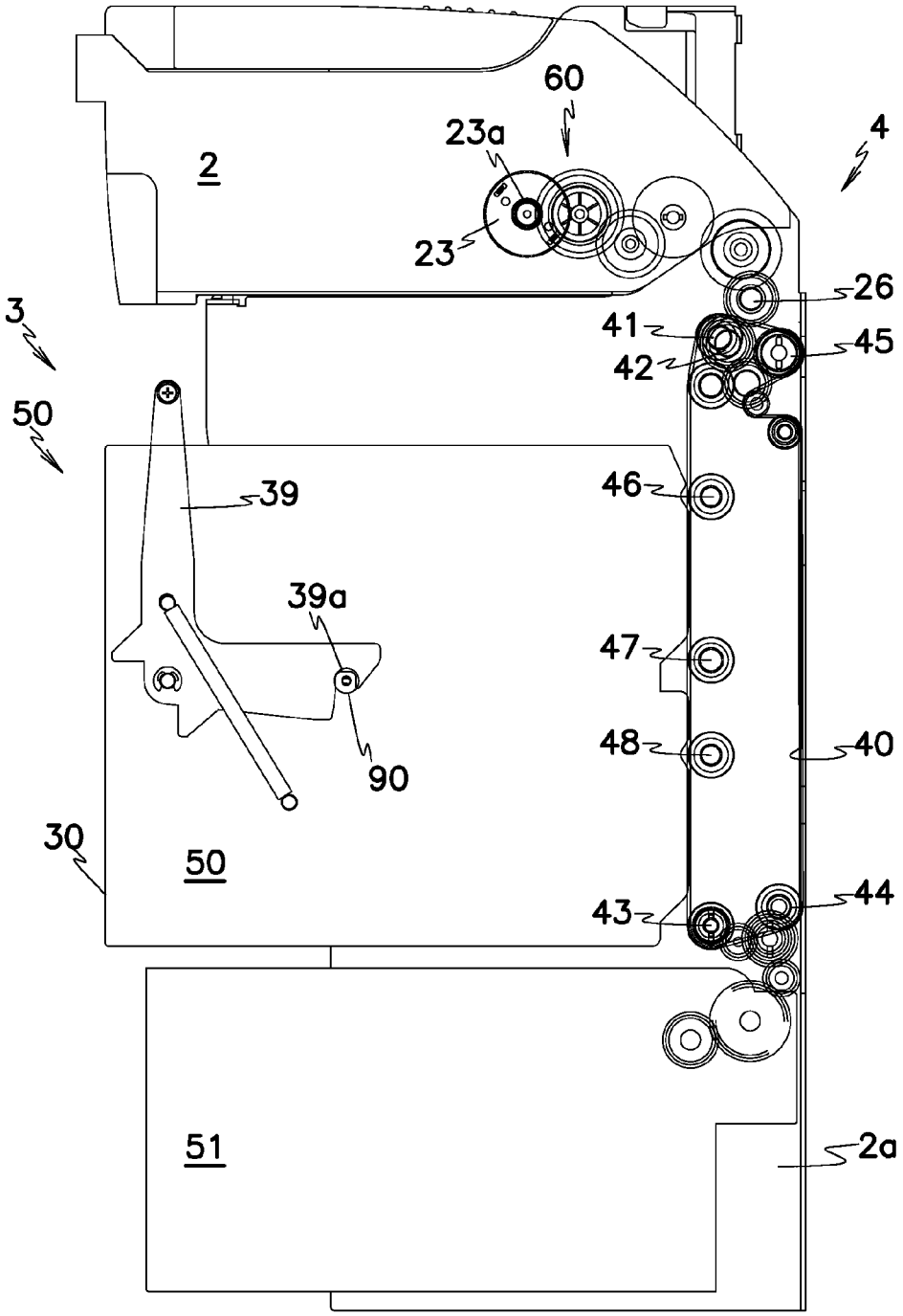
FIG. 4 A section view showing a first gear train of a main conveyor in a bill validator in FIG. 1.

Validator 2 comprises an inlet 20 for receiving bills as documents to be inserted into validator 2, an outlet 21 for discharging the bill from a validation area of validator 2, a validation passageway 22*a* for guiding the bill transported between inlet 20 and outlet 21, a validation conveyor 22 for transporting the bill along validation passageway 22*a*, a stack motor 24 in validator 2 for driving a second gear train (a second power transmission) 69 (FIG. 5) drivingly connected to gears 64, 65 in a container 51, an inlet sensor 20*a* for detecting the bill inserted or dispensed, and an outlet sensor 21*a* for detecting the bill discharged from the validation area. Validation conveyor 22 comprises a conveyor motor 23, a conveyor belt 22*b* driven by conveyor motor 23 for transporting the bill along validation passageway 22*a*, a plurality of pulleys 22*c* with conveyor belt 22*b* wound therearound, and a plurality of idle rollers 22*d* in contact to conveyor belt 22*b* for transporting the bill while diverting the direction of conveyor belt 22*b*. Conveyor motor 23 also serves to drive a main conveyor belt 40 through a first gear train (a first power transmission) 60 and a gear 26 (FIG. 4) to transport the bill along a main passageway 6 in main conveyor 4. Provided along validation passageway 22*a* is a validation sensor 10 for detecting optical or magnetic features of the bill. As illustrated in FIG. 4, rotation power of conveyor motor 23 is transmitted from a gear 23*a* secured on a drive shaft of conveyor motor 23 to first gear train 60, and as illustrated in FIG.

5, rotation power of stack motor 24 is transmitted from a gear 24*a* secured on a drive shaft of stack motor 24 to second gear train 69.

Outlet 21 of validation area in validator 2 is communicated with validation passageway 22*a* formed in validator 2 and also with main passageway 6 formed in main conveyor 4 disposed downstream of validator passageway 22*a*. As shown in FIG. 4, main conveyor 4 comprises an outlet gear 26 drivingly connected to first gear train 60, a driven gear 42 meshed with outlet gear 26, a pulley 41 secured to driven gear 42, and main conveyor belt 40 wound around pulleys 41, 43, 44, 45. Main conveyor belt 40 is also wound around idle rollers 46, 47, 48 for applying tensional force to main conveyor belt 40.

Figure 2:
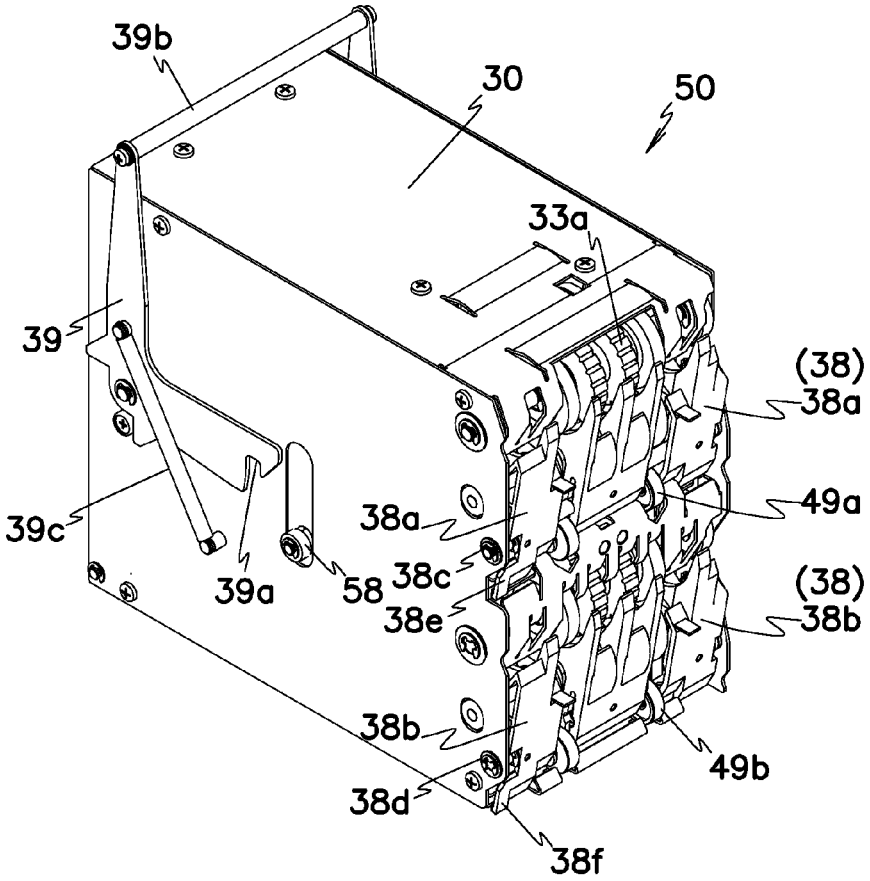
FIG. 2 A perspective view of a storage removably attached to the bill validating/stacking/dispensing device shown in FIG. 1.
Figure 3:
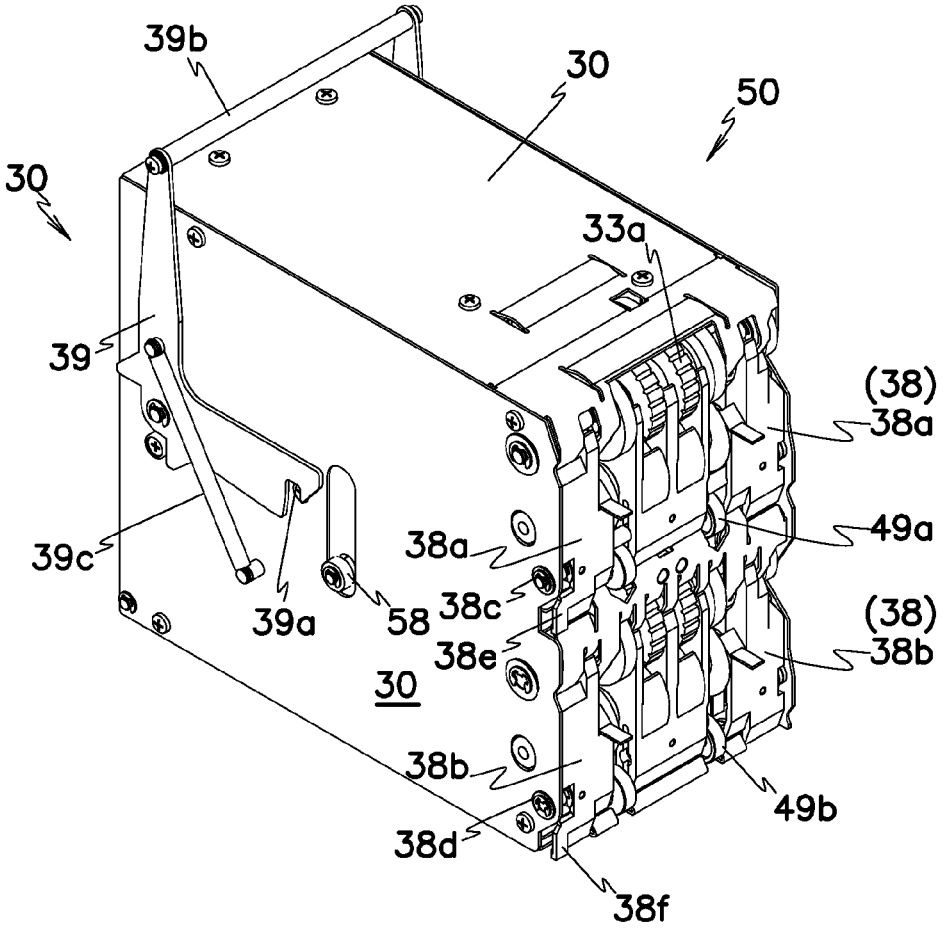
FIG. 3 A perspective view of the storage shown in FIG. 2 with deflection levers in the closed position.

As shown in FIGS. 2 and 3, stacker 3 comprises a plurality of pinch rollers 49, 49*a*, 49*b* rotatably mounted in stacker 3 and releasably pressed against main conveyor belt 40 on the opposite side of mating idle rollers 46, 47, 48 when stacker 3 is attached to validator 2. The bill from outlet 21 of validation passageway 22*a* is sent to main passageway 6 of main conveyor 4, and then, grasped between main conveyor belt 40 and pinch roller 49 to ensure transportation of the bill along main passageway 6 toward storage 50 or container 51 of stacker 3 during movement of main conveyor belt 40.

Figure 5:
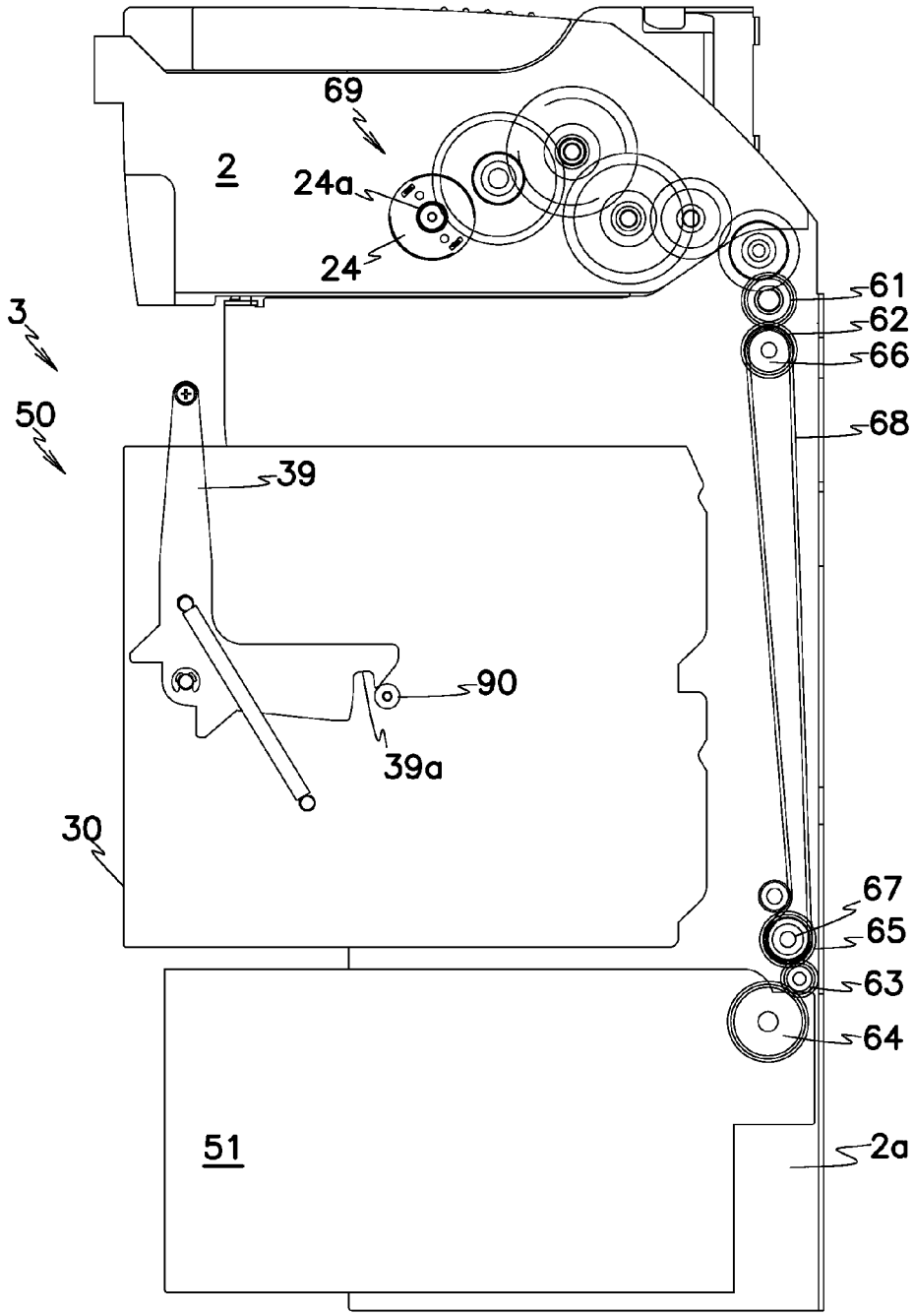
FIG. 5 A section view showing a second gear train for stowing bills into a container in the bill validator of FIG. 1.

Disposed vertically under and adjacent to upper and lower stackers 31 and 32 is container 51 that stores in the non-recyclable condition bills of single kind or different kinds no storable in upper and lower stackers 31 and 32. As shown in FIG. 5, an end gear 61 is engaged with second gear train 69 in validator 2 and also interlocked with an upper gear 62 for power transmission. A drive belt 68 is wound around an upper pulley 66 secured to pulley gear 62 and also around a lower pulley 67 secured to a lower gear 65. Rotation of drive belt 68 causes lower pulley 67 and gear 65 to rotate to simultaneously further transmit the rotation force to a gear 63 meshed with lower gear 65 and a container gear 64 rotatably mounted in container 51. Container gear 64 works with a container pulley attached thereto not shown in the drawings and with a container belt wound around the container pulley to drive container pulley and belt through container gear 64 so as to stow in container 51 bills sent via main conveyor 4. When a bill is transported by main conveyor 4 shown in FIG. 1 toward container 5, it passes a passage sensor 203 that detects a leading edge of the transported bill to produce a detection signal to a control device (a discrimination/conveyance controller) 200 comprised of CPU or CPUs shown in FIG. 19 that then provides a drive signal for stack motor 24. Thereby, stack motor 24 is rotated to drive the belt (not shown) in container 51 and introduce the non-reusable bill into container 51. After that, stack motor 24 is driven in the adverse direction to operate a stack mechanism (not shown) to store the non-reusable bill in container 51.

By way of example, the embodiment may rotate reversible motors 70*a*, 70*b* in main conveyor 4 in the one or forward direction to drive storage conveyors 5 and stock a bill fed from validator 2 into storage 50, and to the contrary, it may rotate reversible motors 70*a*, 70*b* in the adverse direction to reversely drive storage conveyors 5 and pick out bills received in upper and lower storage spaces 31*a* and 32*a* of upper and lower stackers 31, 32 to transport and dispense them through main passageway 6 from inlet 20 of validator 2. In addition, as is apparent from FIG. 6, storage conveyor 5 comprises upper and lower (first and second) reversible conveyors 53 and 54. Upper reversible conveyor 53 comprises a follower gear 35*a* detachably engaged with drive gear 76*a* driven by upper reversible motor 70*a* in main conveyor 4, and feed and delivery rollers 33*a*, 34*b* driven by follower gear 35*a* for transportation of bills into upper storage space 31*a* of upper stacker 31. Likewise, lower reversible conveyor 54 comprises a follower gear 35*b* detachably engaged with a drive gear 76*b* driven by lower reversible motor 70*b* in main conveyor 4, and feed and delivery rollers 33*b*, 34*b* driven by follower gear 35*b* for transporting bills into lower storage space 32*a* of lower stacker 32. Collectively herein referred to as reversible motors 70, feed and delivery rollers 33, 34, follower gears 35, drive gears 76 and pinch rollers 49 are respectively reversible motors 70*a*, 70*b*, feed and delivery rollers 33*a*, 33*b*, 34*a*, 34*b*, follower gears 35*a*, 35*b*, drive gears 76*a*, 76*b* and pinch rollers 49*a*, 49*b*. In this way, reversible motors 70 may work with or drive storage conveyors 5 drivingly connected to reversible motors 70, and storage conveyors 5 may be detached from reversible motors 70 when storage 50 is removed from validator 2. Accordingly, storage 50 may be made in its reduced weight because storage conveyors 5 dispense with their own power source.

In this way, storage conveyors 5 in stacker 3 are driven in bidirectional ways by reversible motors 70, to drive each storage conveyor 5 in the forward direction in order to store in upper or lower storage 31*a* or 32*a* of upper or lower stacker 31 or 32 bills fed from validator 2 and to drive each storage conveyor 5 in the adverse direction in order to extract bills from upper or lower storage 31*a* or 32*a* of upper or lower stacker 31 or 32 and send it by main conveyor 4 to validator 2 for dispensation. When storage 50 is attached to validator 2, storage conveyors 5 in stacker 3 are automatically brought into driving connection to reversible motors 70 in main conveyor 4 to drive storage conveyors 5 systematically and organically or in conjunction with operation of main conveyor 4. Also, as storage 50 is detachably attached to frame 2*a* of validator 2, it may be separated from validator 2 to collect and count bills in upper and lower storage spaces 31*a* and 32*a* of upper and lower stackers 31 and 32. In addition, after storage 50 is extracted ahead of and removed from frame 2*a* of validator 2, an operator may access main conveyor 4 for its easy maintenance, inspection and repair. Thus, the present invention may provide a lightweight, small-sized and highly reliable bill validating/stacking/dispensing device with its simplified mechanism because it comprises storage 50 removable ahead of the device for its easy maintenance and management.

As shown in FIGS. 1 to 3, storage 50 comprises a metallic or plastic casing 30 for making up an outer shell of storage 50 removably fit within frame 2*a* of validator 2, and upper and lower (first and second) stackers 31 and 32 respectively mounted vertically and immediately adjacent to each other at upper and lower portions in casing 30. For example, upper and lower stackers 31 and 32 may store bills of the specific and/or different denomination in the extractable fashion in their upper and lower storage spaces 31*a* and 32*a*.

As is illustrated in FIGS. 6 to 9, storage 50 comprises upper and lower stackers 31 and 32 each of which has a storage conveyor 5 that comprises feed rollers 33*a*, 33*b* for putting bills from main passageway 6 in upper and lower stackers 31, 32, delivery rollers 34*a*, 34*b* for taking out bills from upper and lower stackers 31, 32 to main passageway 6, support plates 57*a*, 57*b* for defining upper or lower storage 31*a*, 32*a* for stored bills, bottom plates 55*a*, 55*b* for supporting bills under support plates 57*a*, 57*b*, and pusher members 56*a*, 56*b* arranged above support plates 57*a*, 57*b* for stowing bills into upper or lower storage 31*a*, 32*a* when support plates 57*a*, 57*b* are upwardly moved. In this description, bottom plates 55, support plates 57 and pusher members 56 respectively typically denote upper and lower bottom plates 55*a*, 55*b*, upper and lower support plates 57*a*, 57*b* and upper and lower pusher members 56*a*, 56*b*.

As shown in FIG. 1, provided in upper and lower stackers 31, 32 are feed rollers 33*a*, 33*b* in contact to main conveyor belt 40 to grasp a transported bill between feed rollers 33*a*, 33*b* and main conveyor belt 40. Reversible motors 70*a*, 70*b* are operated to simultaneously drive feed rollers 33*a*, 33*b* and delivery rollers 34*a*, 34*b* in upper and lower stackers 31, 32.

As shown in FIGS. 1 to 3, 7 and 8 and 16 to 18, upper and lower stackers 31, 32 each comprise upper and lower (first and second) deflection levers 38*a* and 38*b* each movable between their opened and closed positions. Specifically, upper and lower deflection levers 38*a* and 38*b* are in the opened position to guide a bill supplied from validator 2 through main passageway 6 into upper and lower stackers 31, 32 and also to guide a bill discharged from upper and lower stackers 31, 32 through main passageway 6 to validator 2. To the contrary, upper and lower deflection levers 38*a* and 38*b* are in the closed position to block passage of a bill between upper or lower stacker 31, 32 and main passageway 6, however, they are designed in the closed position neither to project into main passageway 6 nor to block a bill from being stowed into the opened stacker or container 51 or a bill from being taken out from the opened stacker. Upper and lower deflection levers 38*a* and 38*b* are herein collectively referred to as deflection levers 38. Upper and lower deflection levers 38*a* and 38*b* are pivoted respectively around upper and lower shafts 38*c* and 38*d* for their rotation between the opened and closed positions.

Figure 7:
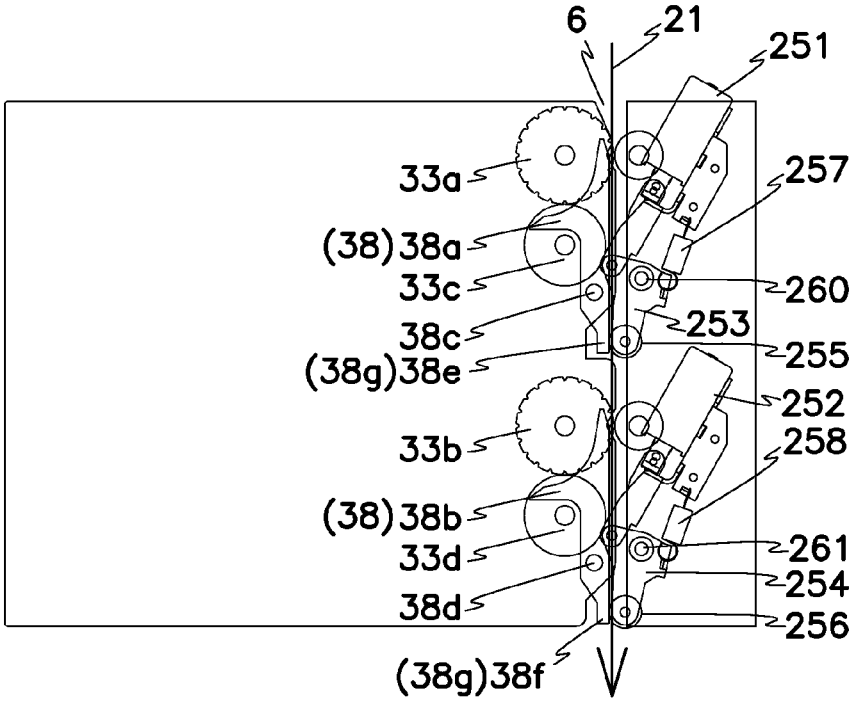
FIG. 7 A section view showing the deflection levers in the closed condition for blocking communication between the storage and a main passageway to transport bills to the container through the main passageway.
Figure 8:
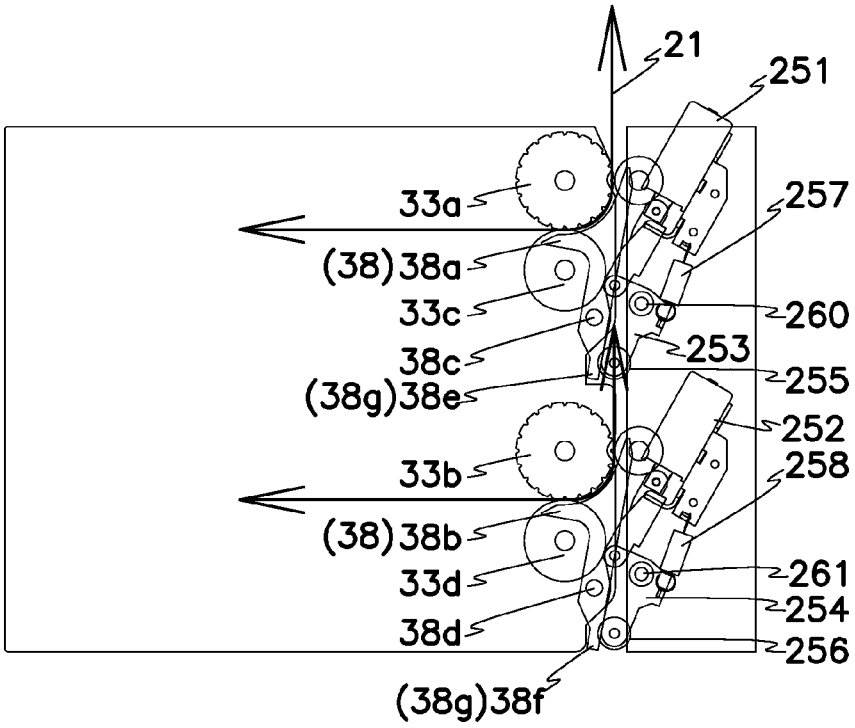
FIG. 8 A section view showing the deflector levers in the opened condition for allowing communication between the storage and the main passageway.

FIGS. 7 and 8 illustrate main conveyor 4 that comprises an upper solenoid (a first actuator) 251 for shifting upper deflection lever 38*a* between the opened and closed positions through an upper intermediate lever 253 (FIG. 7) rotatably mounted around a shaft 260 attached to main conveyor 4, a lower solenoid (a second actuator) 252 for shifting lower deflection lever 38*b* between the opened and closed positions through a lower intermediate lever 254 rotatably mounted around a shaft 261 attached to main conveyor 4, an upper spring 257 for resiliently urging upper intermediate lever 253 toward an inoperative position to elastically push upper deflection lever 38*a* toward the closed position, and a lower spring 258 for resiliently urging lower intermediate lever 254 toward an inoperative position to elastically push lower deflection lever 38*b* toward the closed position. Attached at the bottom end of upper intermediate lever 253 is an upper lever roller 255 in contact to upper deflection lever 38*a*, and also, attached at the bottom end of lower intermediate lever 254 is a lower lever roller 256 in contact to lower deflection lever 38*b*. Collectively referred herein to as solenoids 261, intermediate levers 262, springs 263 and lever rollers 264 are respectively upper and lower solenoids 251 and 252, upper and lower intermediate levers 253 and 254, upper and lower springs 257 and 258 and upper and lower lever rollers 255 and 256.

When upper solenoid 251 is activated, upper intermediate lever 253 is rotated in the clockwise direction around shaft 260 against resilient force of upper spring 257, and simultaneously upper lever roller 255 pushes upper lever end 38*e* into upper storage space 31*a* of upper stacker 31. This causes upper deflection lever 38*a* to rotate around upper shaft 38*c* in the clockwise direction from the closed position shown in FIG. 7 to the opened position shown in FIGS. 1 and 8 so that a tip of upper deflection lever 38*a* comes into main passageway 6. Adversely, when upper solenoid 251 is deactivated, upper intermediate lever 253 is rotated in the counterclockwise direction around shaft 260 by virtue of elastic force of upper spring 257 to separate upper lever roller 255 from upper lever end 38*e*; then upper deflection lever 38*a* is rotated in the counterclockwise direction by an elastic force of a spring not shown from the opened to the closed position; and the tip of upper deflection lever 38*a* is retracted out of main passageway 6 (FIG. 7).

In a similar manner, when lower solenoid 252 is activated, lower intermediate lever 254 is rotated around shaft 261 in the clockwise direction against elastic force of lower spring 258 so that lower lever roller 256 pushes lower lever end 38*f* into lower storage space 32*a* of lower stacker 32. This causes lower deflection lever 38*b* to rotate around upper shaft 38*c* in the clockwise direction from the closed to the opened position so that a tip of lower deflection lever 38*b* comes into main passageway 6 (FIGS. 1 and 8). Adversely, when lower solenoid 252 is deactivated, intermediate lever 254 is rotated in the counterclockwise direction around shaft 261 by virtue of elastic force of lower spring 258 to separate upper lever roller 255 from upper lever end 38*e*; then lower deflection lever 38*b* is rotated in the counterclockwise direction by an elastic force of a spring not shown from the opened to the closed position; and the tip of lower deflection lever 38*b* is retracted out of main passageway 6 (FIG. 7). In this way, upper and lower deflection levers 38*a* and 38*b* may be independently rotated between the closed and opened positions by respective operation of upper and lower solenoids 251 and 252. This arrangement may establish simple contacts between upper lever end 38*e* of upper deflection lever 38*a* and upper lever roller 255 and also between lower lever end 38*f* of lower deflection lever 38*b* and lower lever roller 256 to allow upper and lower deflection levers 38*a* and 38*b* to be separated from respectively upper and lower solenoids 251 and 252 when storage 50 is removed from validator 2. Upper and lower deflection levers 38*a* and 38*b* are used to guide and take bills in or out of respectively upper and lower storage spaces 31*a* and 32*a* of upper and lower stackers 31 and 32. Collectively referred herein as to lever ends 38*g* are upper and lower lever ends 38*e* and 38*f*.

Figure 6:
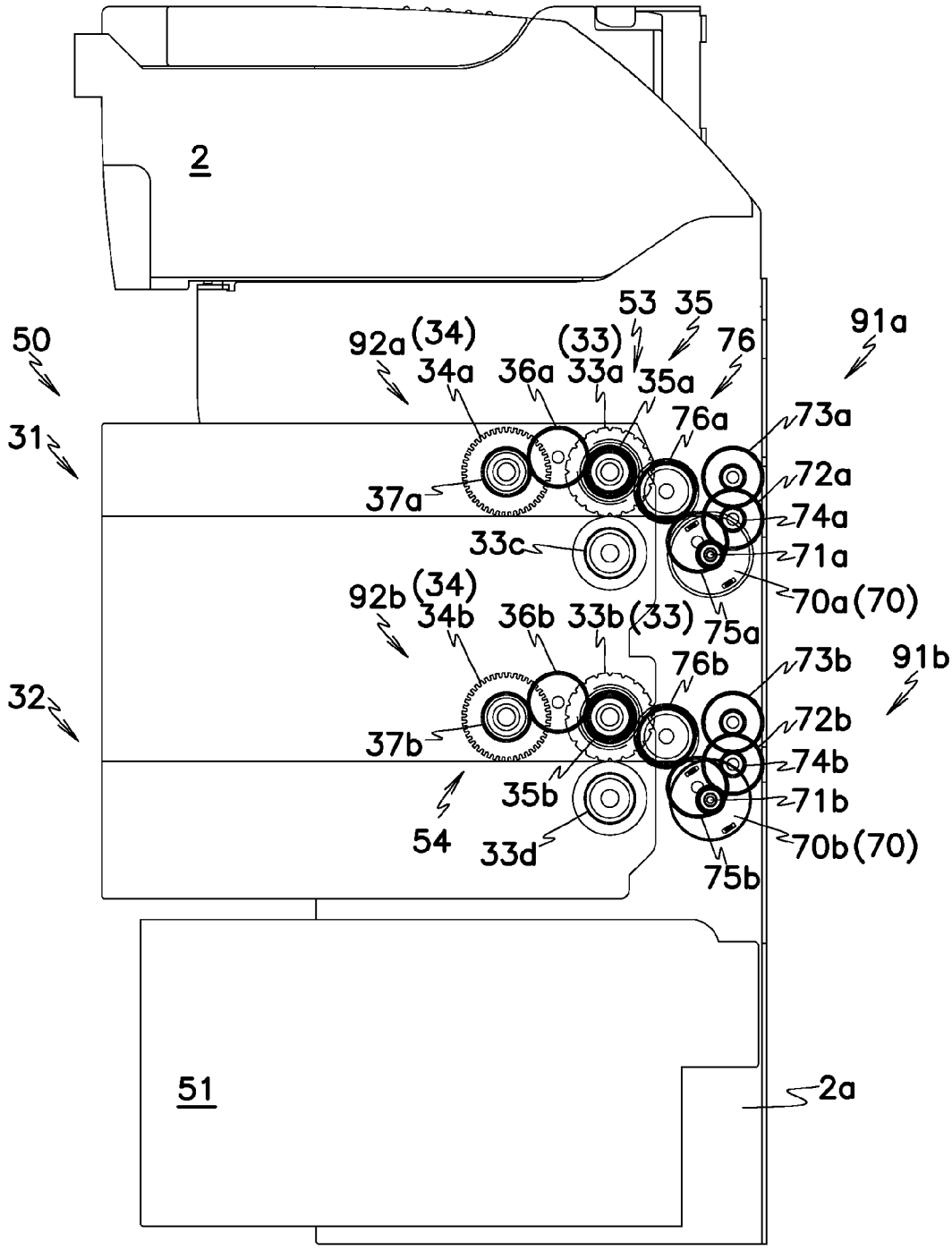
FIG. 6 A section view showing a stack conveyor in the storage in separable driving connection to a reversible motor in the bill validator.

FIG. 6 indicates main conveyor 4 that comprises a first gear train 91*a* comprising an upper pinion 71*a* mounted on an output shaft of an upper conveyor motor 70*a* in upper stacker 31, an upper first gear 72*a* meshed with upper pinion 71*a*, an upper second gear 74*a* secured to upper first gear 72*a* for their integral rotation, an upper third gear 75*a* meshed with upper second gear 74*a*, and an upper fourth gear 76*a* meshed with upper third gear 75*a*. Main conveyor 4 also has a second gear train 91*b* that similarly comprises a lower pinion 71*b* mounted on an output shaft of a lower conveyor motor 70*b* in lower stacker 32, a lower first gear 72*b* meshed with lower pinion 71*b*, a lower second gear 74*b* secured to lower first gear 72*b* for integral rotation, a lower third gear 75*b* meshed with lower second gear 74*b*, and a lower fourth gear 76*b* meshed with lower third gear 75*b*.

Upper stacker 31 has a first driven gear train 92*a* that comprises an upper follower gear 35*a* detachably meshed with an upper drive gear 76*a*, an upper fourth gear 36*a* meshed with upper follower gear 35*a*, and an upper fifth gear 37*a* meshed with upper fourth gear 36*a*. Upper feed roller 33*a* and delivery roller 34*a* are integrally formed with respectively upper intermediate and fifth gears 35*a* and 37*a*. Likewise, lower stacker 32 has a second driven gear train 92*b* that comprises a lower follower gear 35*b* detachably meshed with a lower drive gear 76*b*, a lower fourth gear 36*b* meshed with lower follower gear 35*b*, and a lower fifth gear 37*b* meshed with lower fourth gear 36*b*. Lower feed and delivery rollers 33*b* and 34*b* are integrally formed with respectively lower intermediate and fifth gears 35*b* and 37*b*.

Figure 9:
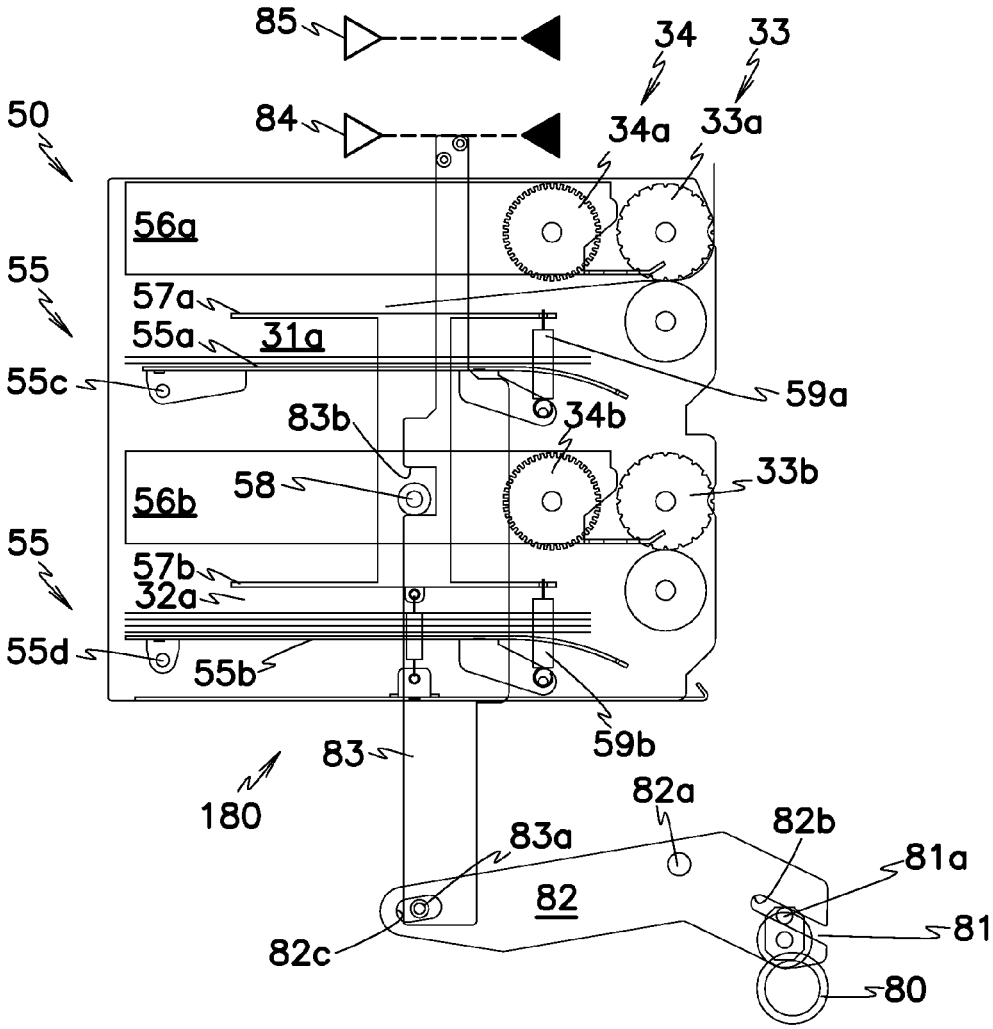
FIG. 9 A partial and longitudinal section view of the storage taken along a plane transverse or perpendicular to a paper plane of FIG. 10.
Figure 10:
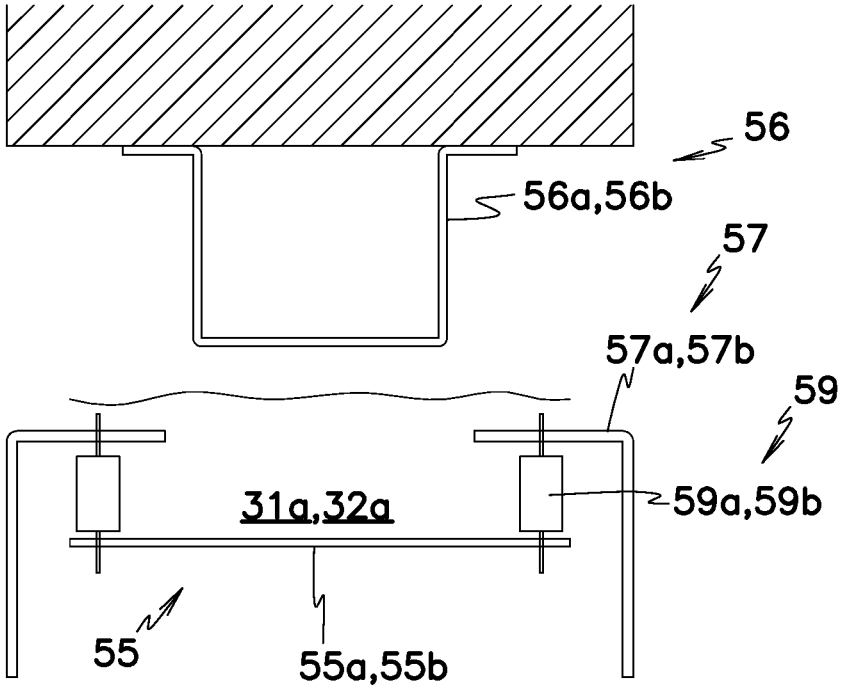
FIG. 10 A partial section view of the storage showing a condition just before stowing a bill into the storage wherein the bill supplied from the validator is supported on a support plate of the storage.
Figure 11:
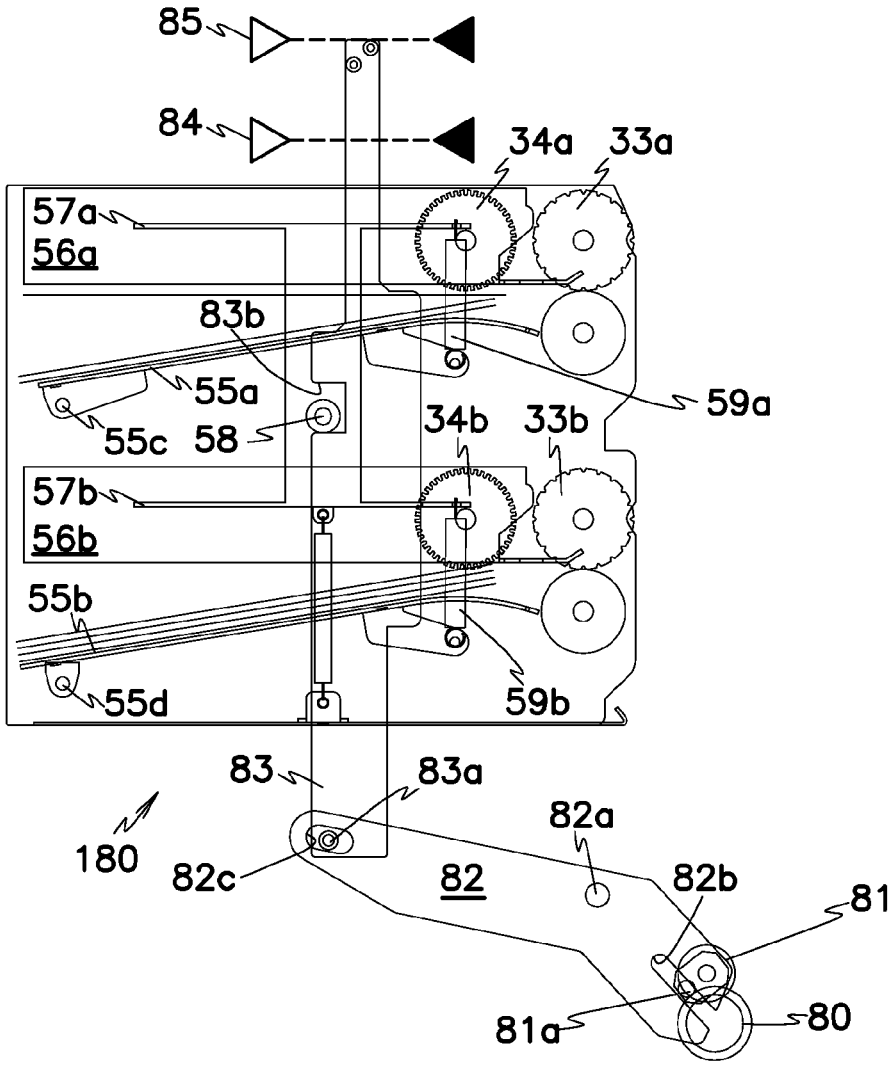
FIG. 11 A section view showing the bill stowed in the storage by a pusher plate.

FIGS. 9 and 11 depict a lifter 180 attached to a side wall of a frame 2*a* in validator 2 for vertically moving support plates 57*a* and 57*b* in stackers 31, 32 of storage 50 between lowered and elevated positions in accordance with vertical movement of a rod 83 in lifter 180. As shown in FIG. 9, lifter 180 comprises a lifter motor 80 attached to validator 2, a rotary disk 81 rotated by lifter motor 80, a pin 81*a* attached at an eccentric position away from a central axis on rotary disk 81, a lift lever 82 rotatable around a shaft 82*a* and formed with a notch 82*b* for receiving pin 81*a*, a pin 83*a* formed with rod 83 and received within an elongated hole 82*c* bored at an end of lift lever 82, upper and lower support plates 57*a* and 57*b* integrally formed into a generally upset H-shape in storage 50, a roller 58 formed on support plates 57*a* and 57*b* and received within a cutout 83*b* of rod 83, upper (first) and lower (second) bottom plates 55*a* and 55*b* each rotatable around shafts 55*c*, 55*d* within upper and lower stackers 31 and 32, and upper and lower pusher members 56*a* and 56*b* secured to casing 30 above related upper and lower support plates 57*a* and 57*b* each connected to upper and lower bottom plates 55*a* and 55*b* through springs 59*a* and 59*b*.

Figure 12:
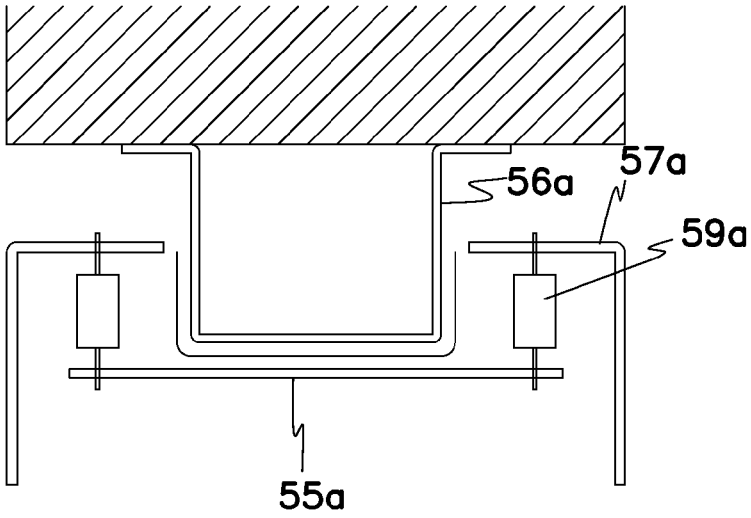
FIG. 12 A section view taken along a plane transverse or perpendicular to a paper plane of FIG. 11.
Figure 13:
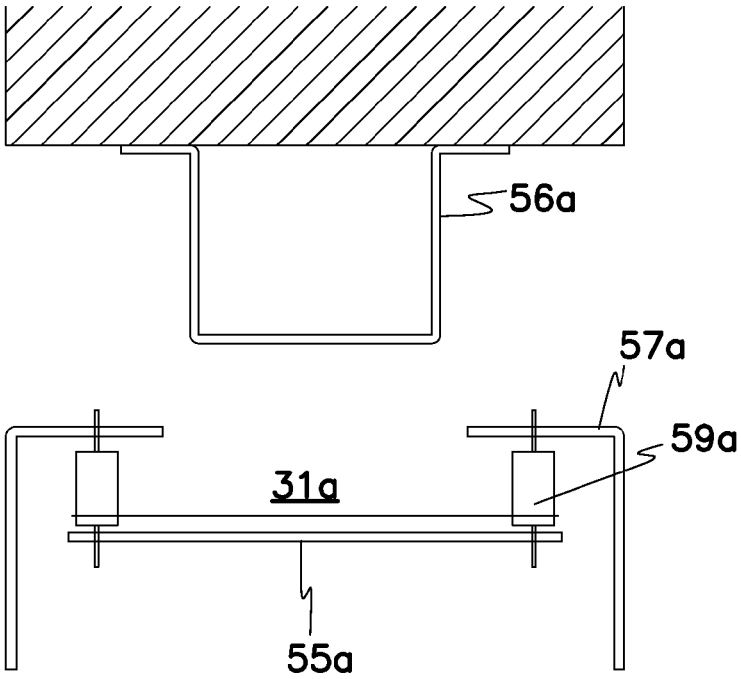
FIG. 13 A partial section view showing the bill completely stowed into the storage.
Figure 14:
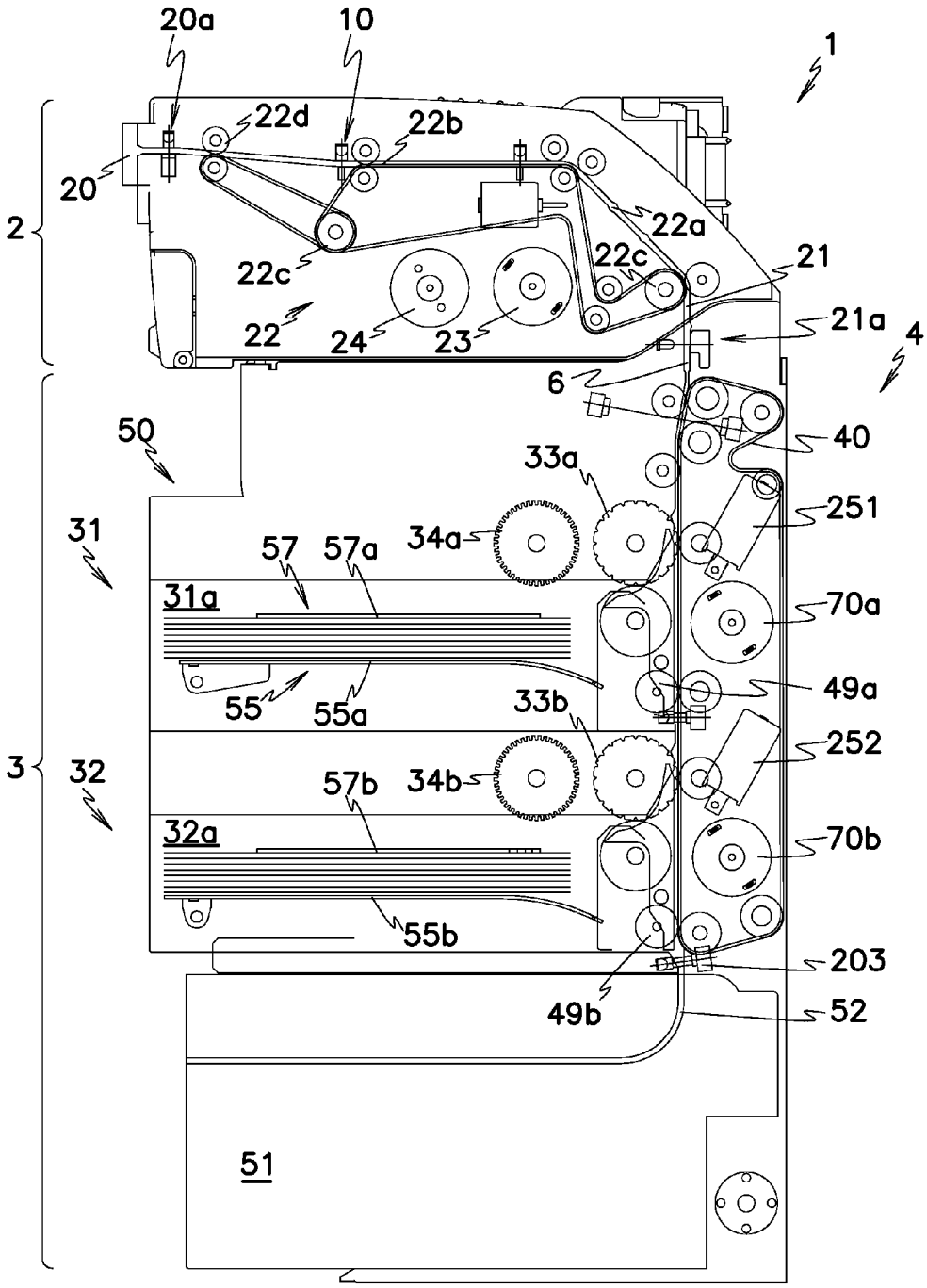
FIG. 14 A section view showing bills introduced into the storage from the bill validator.
Figure 15:
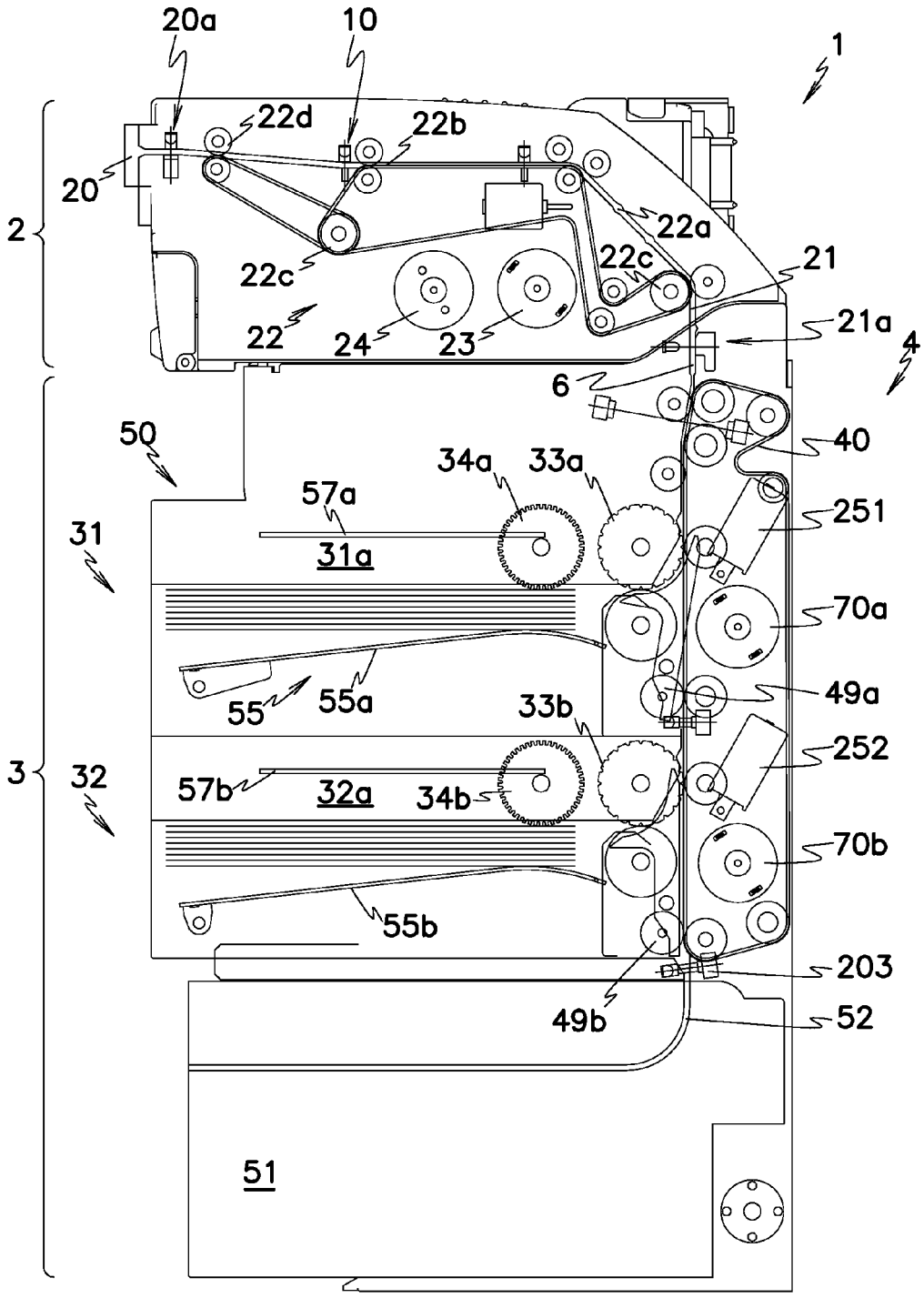
FIG. 15 A section view showing bills on a bottom plate in the elevated position to discharge and transport a bill from the storage toward the bill validator.

When lift motor 80 is rotated in the forward direction, lift lever 82 is rotated in the clockwise direction around shaft 82*a* through rotary disk 81 to elevate rod 83. This causes support plates 57 to travel from the lower position shown in FIG. 9 toward stationary pusher members 56*a*, 56*b* to the upper position shown in FIG. 11 along with rod 83 while springs 59*a*, 59*b* are expanded against their resilient force with the rise of rod 83 and support plates 57 to the upper position. Then, when a bill has completely been supplied from feed rollers 33*a*, 33*b* onto support plates 57*a*, 57*b*, they are elevated together with rod 83, and then, as illustrated in FIG. 12, pusher members 56*a*, 56*b* push and stow the bill into support plates 57*a*, 57*b* onto bottom plates 55*a*, 55*b* against resilient force of springs 59*a*, 59*b*. After that, when lift motor 80 further rotates in the forward direction, lift lever 82 rotates in the counterclockwise direction to lower rod 82 and support plates 57*a*, 57*b* in unison. Here, as shown in FIG. 13, springs 59*a*, 59*b* are contracted by their own elasticity while both sides of the bill are laid on bottom plates 55*a*, 55*b*.

Figure 17:
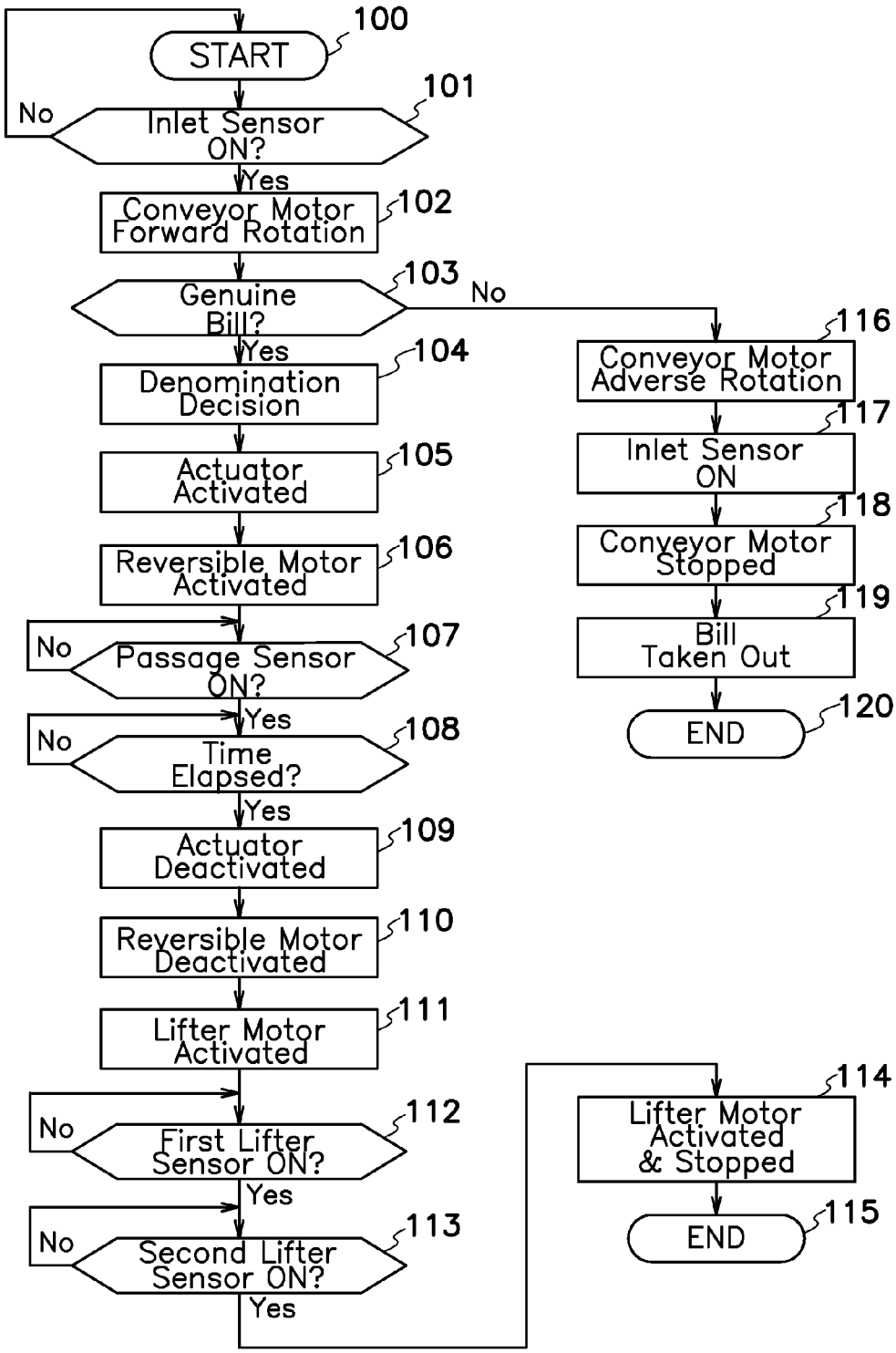
FIG. 17 A flow chart showing an operational sequence for stowing a bill into the storage.

Now, stacking operations of bills will be described hereinafter with reference to the operational sequence of flow chart shown in FIG. 17. Processing moves on from START in Step 100 to 101 where control device 200 decides on whether or not inlet sensor 20*a* is turned on by insertion of a bill into inlet 20. When control device 200 decides reception of an electric detection signal from inlet sensor 20*a* by a bill insertion, it causes conveyor motor 23 to rotate in the forward direction (in Step 102). Therefore, the bill is transported along validation passageway 22*a* by validation conveyor 22, and validation sensor 10 converts optical or magnetic features of moving bill into electric detection signals to control device 200 that receives detection signals from validation sensor 10 to decide in Step 103 on whether bill is genuine or not. If the bill is genuine, control device 200 then decides denomination of the bill (in Step 104). As bills of different denominations are stacked in upper and lower storage spaces 31*a* and 32*a* of upper and lower stackers 31 and 32, control device 200 selectively activates related upper or lower solenoid 251 or 252 (in Step 105) to selectively rotate upper or lower deflection lever 38*a* or 38*b* from the closed to the opened position. Then, control device 200 rotates selectively upper or lower reversible motor 70*a* or 70*b* related to the selected denomination (in Step 106). Afterward, control device 200 receives a detection signal from passage sensor 21*a* to confirm that the bill has passed through passage sensor 21*a* (in Step 107), and further it decides (in Step 108) on whether a given period of time has elapsed after passage of the bill through passage sensor 21*a*. Thus, the bill runs along upper or lower deflection lever 38*a* or 38*b* related to the bill denomination into upper or lower stacker 31 or 32 onto support plate 57*a* or 57*b*, and so, control device 200 turns off driven upper or lower solenoid 251 or 252 to rotate upper or lower deflection lever 38*a* or 38*b* from the opened to the closed position (in Step 109) by elastic force of spring not shown, and also control device 200 stops operation of driven upper or lower reversible motor 70*a* or 70*b* (in Step 110).

After that, control device 200 activates lifter motor 80 (in Step 111) to move rod 83 from the lower position of FIG. 9 to the upper position of FIG. 11. In Step 112, when a first lifter sensor 84 detects elevated rod 83, it is turned on to produce a detection signal to control device 200. When upper and lower support plates 57*a*, 57*b* are in the lower position of FIG. 10, control device 200 detects turning-on of first lifter sensor 84 in Step 112, while one of upper and lower support plates 57*a*, 57*b* supports the fed bill thereon. When upper and lower support plates 57*a*, 57*b* are upwardly moved from the lower position to the upper position of FIG. 12, upper or lower pusher member 56*a* or 56*b* forcibly stows the bill on upper or lower support plate 57*a*, 57*b* onto upper or lower bottom plate 55*a* or 55*b* within upper or lower stacker 31 or 32, and control device 200 detects turning-on of a second lifter sensor 85 in Step 113. Processing moves on from Step 113 to 114 where control device 200 further activates lifter motor 80 to lower rod 83, and when first lifter sensor 84 detects rod 83 in the lower position, control device 200 ceases operation of lifter motor 80 to finish the stowing operation of the bill as side edges of the bill are also in contact to bottom plate 55 as shown in FIG. 13.

When control device 200 does not decide the bill to be genuine in Step 103, processing goes on from Step 130 to 116 where control device 200 drives conveyor motor 23 in the adverse direction to return the bill to inlet 20. The bill returned to inlet 20 turns on inlet sensor 20*a* (in Step 117) so that control device 200 stops operation of conveyor motor 23 (in Step 118). Subsequently, when an operator takes out the bill from inlet 20 (in Step 119), procedure completes the returning operation of the bill.

Figure 16:
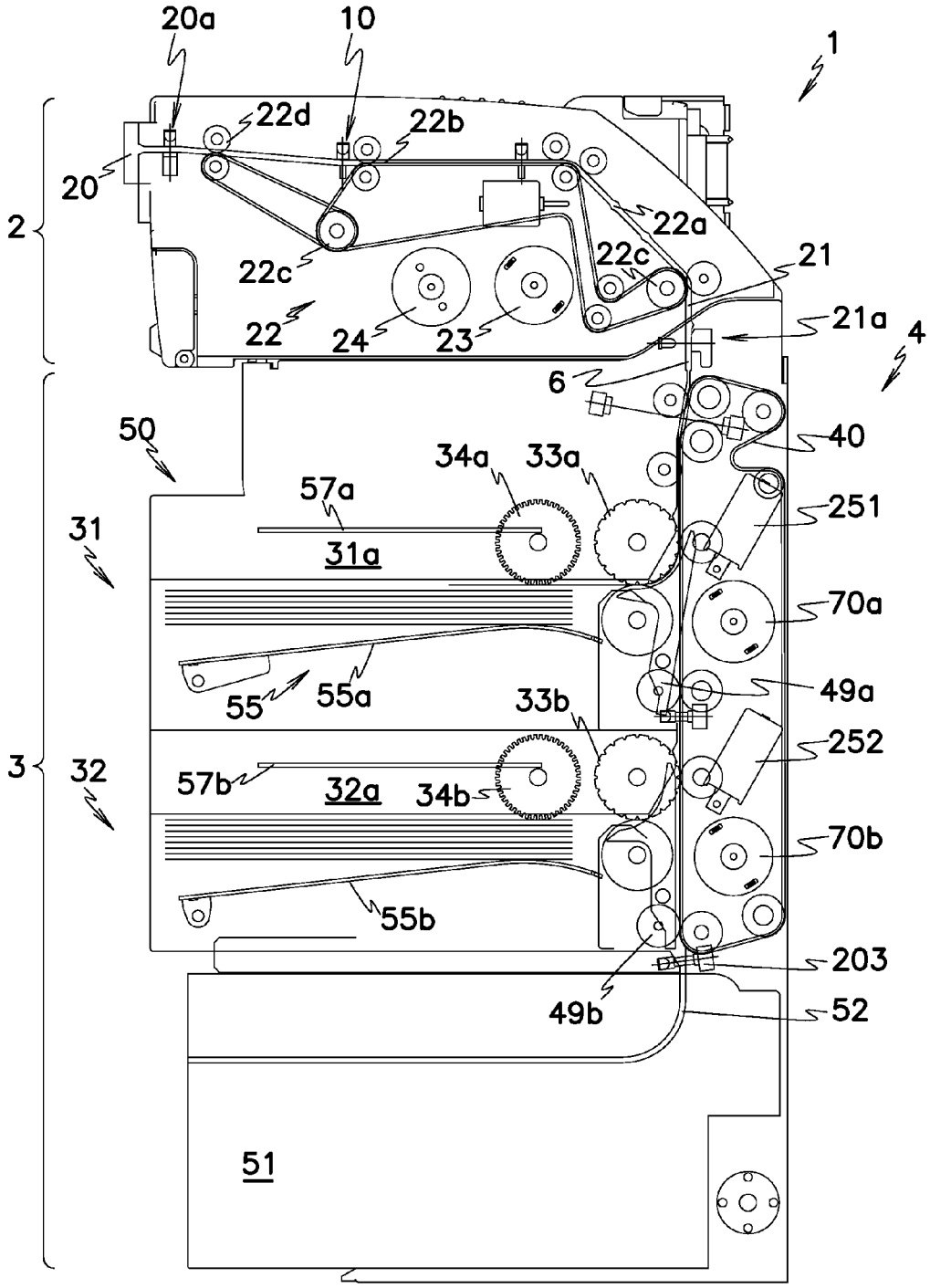
FIG. 16 A section view showing delivery and feed rollers rotated to pick out a bill from the storage toward the bill validator.
Figure 18:
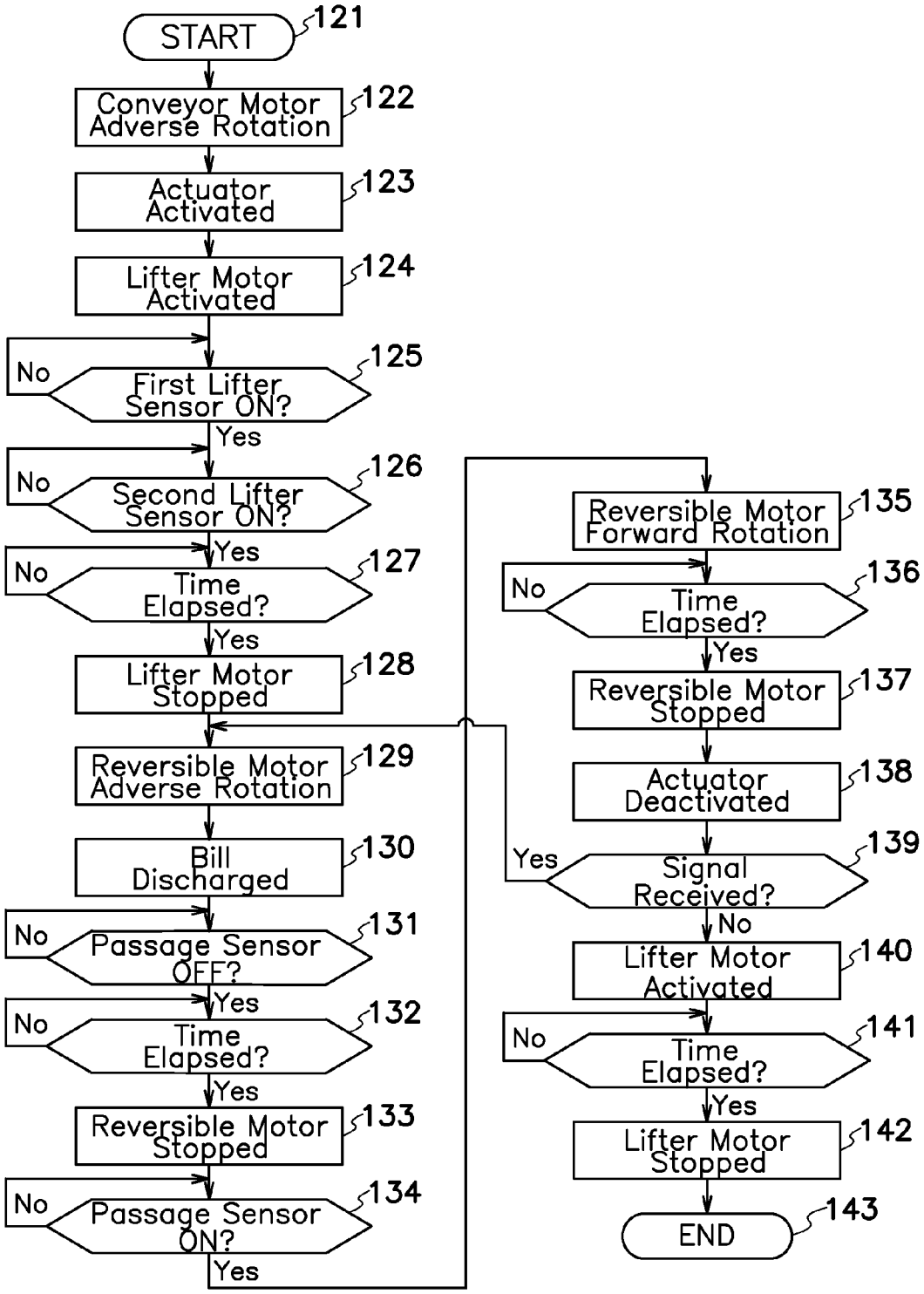
FIG. 18 A flow chart showing an operational sequence for discharging a bill from the storage.
Figure 19:
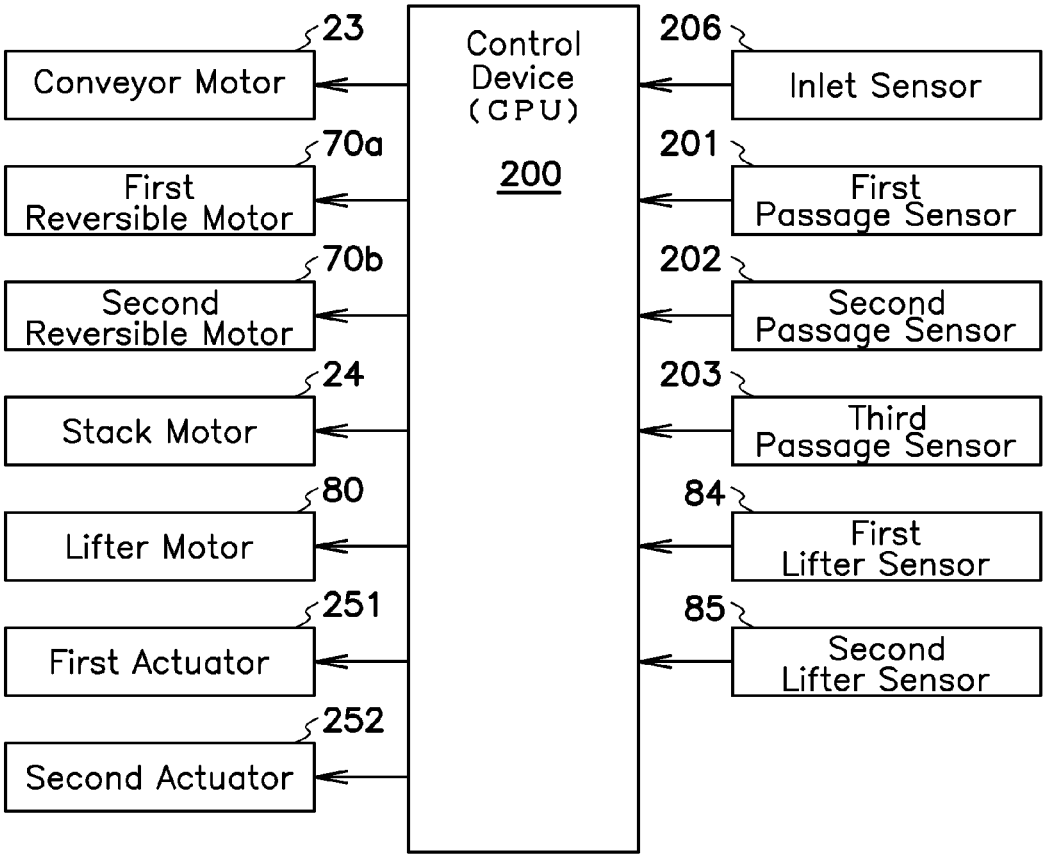
FIG. 19 A block diagram showing an electric circuit in a bill validating/stacking/dispensing device.

Then, the payment operation of bills will be described hereinafter with reference to the operational sequence of flow chart shown in FIG. 18. From Step 121 of START to 122, when control device 200 receives an instruction signal to advance preparation of bill payment, it drives conveyor motor 23 in the adverse direction and at the same time turns on upper or lower solenoid 251 or 252 related to upper or lower stacker 31 or 32 that stores bills of the denomination to be dispensed (in Step 123) to rotate upper or lower deflection lever 38*a* or 38*b* from the closed to the opened position. When lifter motor 80 is then rotated in the forward direction (in Step 124), rod 83 is upwardly moved to sequentially turn on first and second lifter sensors 84 and 85 in Steps 126 and 127. Subsequently, when a given period of time is over after second lifter sensor 85 is turned on, control device 200 stops operation of lifter motor 80 (in Step 128) to maintain rod 83 in the elevated position of FIG. 11 so that upper and lower bottom plates 55*a*, 55*b* are retained in the slant condition shown in FIG. 15. This causes each uppermost one of bills stored in upper and lower storage spaces 31*a* and 32*a* to be in contact to feed rollers 33*a*, 33*b* to finish preparation of bill distribution. Then, as shown in FIG. 16, delivery rollers 34*a*, 34*b* and feed rollers 33*a*, 33*b* are rotated to discharge the uppermost bill from upper or lower storage spaces 31*a* or 32*a* to main passageway 6.

As mentioned before, deflection lever 38 is already in the opened position, and conveyor motor 23 is rotated in the adverse direction. Here, when related upper or lower reversible motor 70*a* or 70*b* is rotated in the adverse direction in Step 129, the bill of the denomination is smoothly discharged from upper or lower storage 31*a* or 32*a* (in Step 130). Then, in Step 131, passage sensor 21*a* detects on whether or not the discharged bill has passed passage sensor 21*a*, and when passage sensor 21*a* is turned off during passage of the bill, it forwards the off-detection signal to control device 200 that then decides on whether or not a given period of time has elapsed after passage of the bill through passage sensor 21*a* (in Step 132), and when the given period of time has elapsed, control device 200 stops drive upper or lower reversible motor 70*a* or 70*b* (in Step 133).

Subsequently, control device 200 decides in Step 134 on whether it receives from passage sensor 21*a* an ON detection signal indicative of finished passage of the bill. When passage sensor 21*a* detects passage of the bill's trailing edge, processing moves on to Step 135 where control device 200 again rotates upper or lower reversible motor 70*a* or 70*b* in the forward rotation to prevent successive discharge from upper or lower storage 31*a*, 32*a* of a subsequent bill just beneath the discharged bill in order to return the subsequent bill in upper or lower storage 31*a*, 32*a*. After a certain period of time since upper or lower reversible motor 70*a* or 70*b* has been rotated in the forward direction, procedure goes on from Step 136 to 137 where control device 200 stops operation of related upper or lower reversible motor 70*a* or 70*b*, and turns off related solenoid 251 or 252 in Step 138 to advance to Step 139. Control device 200 decides in Step 139 on whether or not to again receive another instruction signal for payment, and when control device 200 receives the further instruction signal on payment, processing moves on to Step 129, but when it does not receive such a further instruction signal, control device 200 rotates lifter motor 80 in the forward rotation (in Step 140) to return rod 83 to the lower position shown in FIG. 9, and then, control device 200 decides in Step 141 on whether or not a certain period of time has elapsed after turning-off of first and second lifter sensors 84 and 85. After the certain period of time, control device 200 ceases operation of lifter motor 80 to finish the payment operation of bills.

To remove storage 50 of stacker 3 from validator 2, it is pulled forwardly of validator 2 so that follower gears 35*a*, 35*b* in storage 50 are disengaged from drive gears 76*a*, 76*b* in main conveyor 4, while simultaneously, feed rollers 33*a*, 33*b* and pinch rollers 49*a*, 49*b* in storage 50 are released from contact to main conveyor belt 40 in main conveyor 4.

As shown in FIGS. 2 and 4, stacker 3 comprises a lever 39 rotatably mounted on a side wall 3*a* of casing 30, and a cutout 39*a* formed in lever 39 to releaseably hook cutout 39*a* on a pin 90 attached to frame 2*a* of validator 2 to secure storage 50 to frame 2*a*. When a handle 39*b* connected to lever 39 is pulled down while rotating lever 39, cutout 39*a* is released from pin 90 to detach storage 50 from frame 2*a*.

Conversely, to attach storage 50 to validator 2, it is pushed into validator 2 so that upper and lower follower gears 35*a*, 35*b* in upper and lower reversible conveyors 53 and 54 are automatically brought into engagement with drive gears 76*a*, 76*b* in main conveyor 4, and concurrently, feed rollers 33*a*, 33*b* and pinch rollers 49*a*, 49*b* in upper and lower reversible conveyors 53 and 54 are automatically brought into contact to main conveyor belt 40 in main conveyor 4. Thus, first and second reversible conveyors 53 and 54 in first and second stackers 31 and 32 are removably and drivingly connected to upper and lower reversible motors 70*a* and 70*b* in main conveyor 4.

Figure 20:
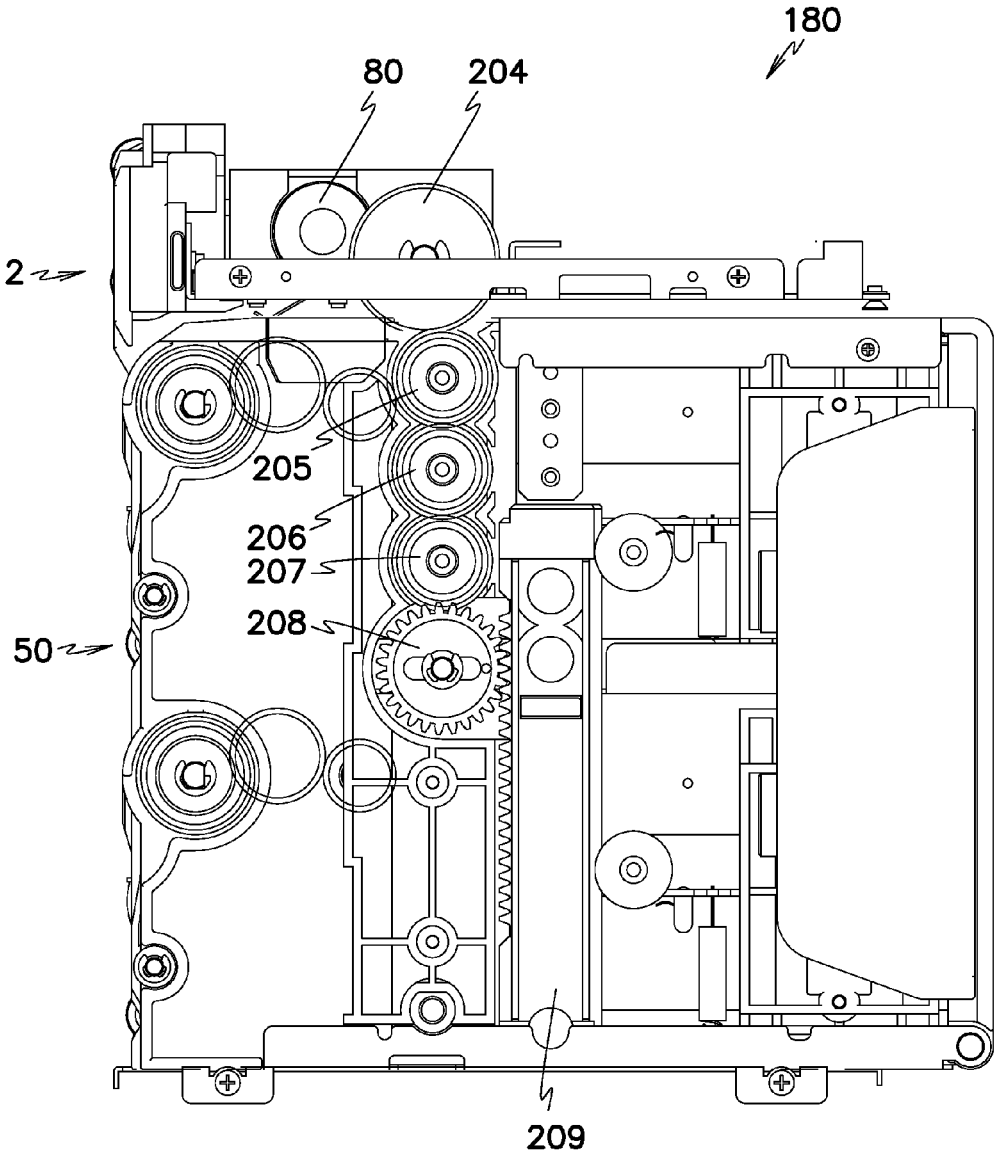
FIG. 20 A section view illustrating another embodiment of a lifter shown in FIG. 9.
Figure 21:
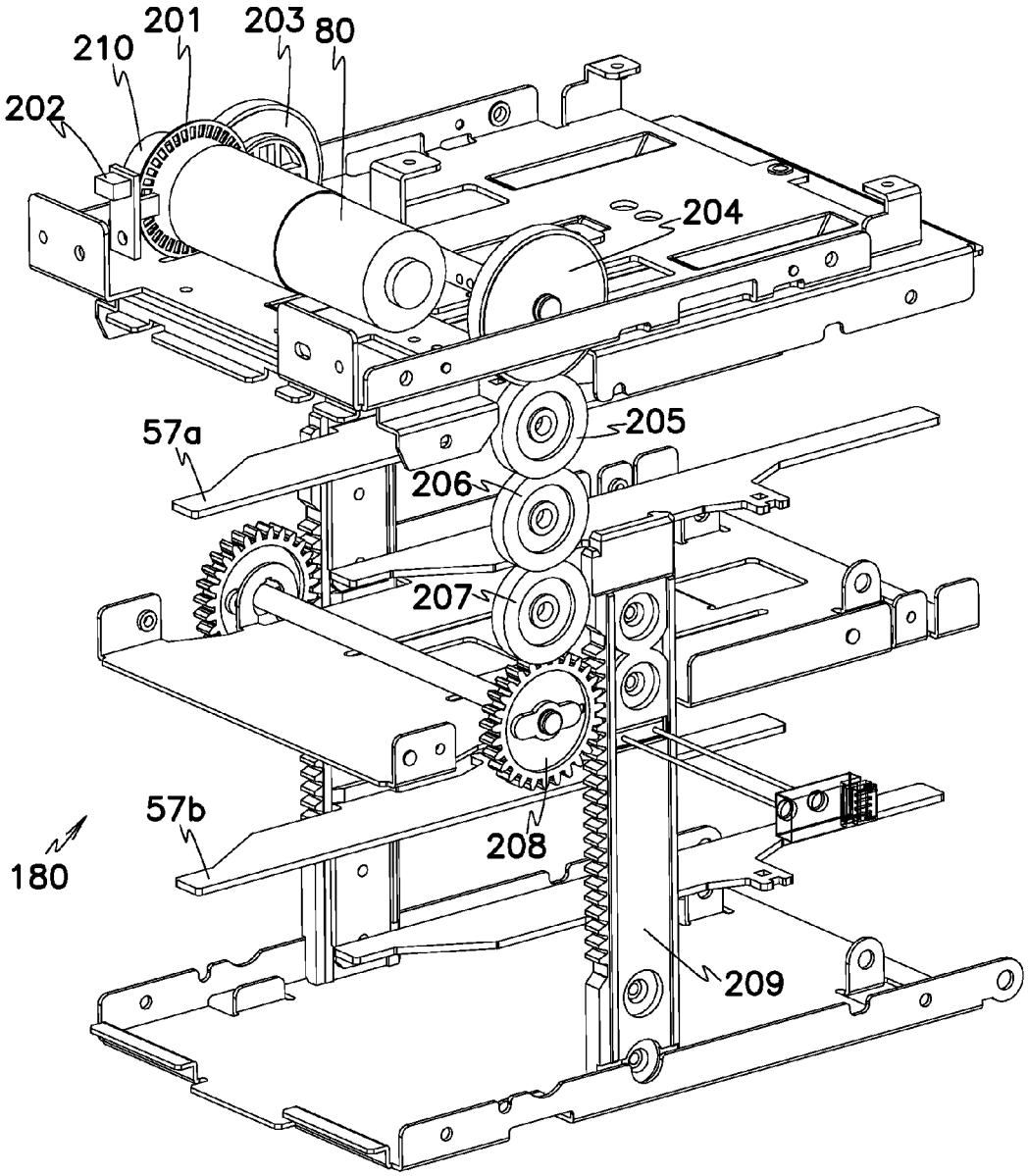
FIG. 21 A perspective view illustrating an interior of the lifter in FIG. 20.
Figure 22:
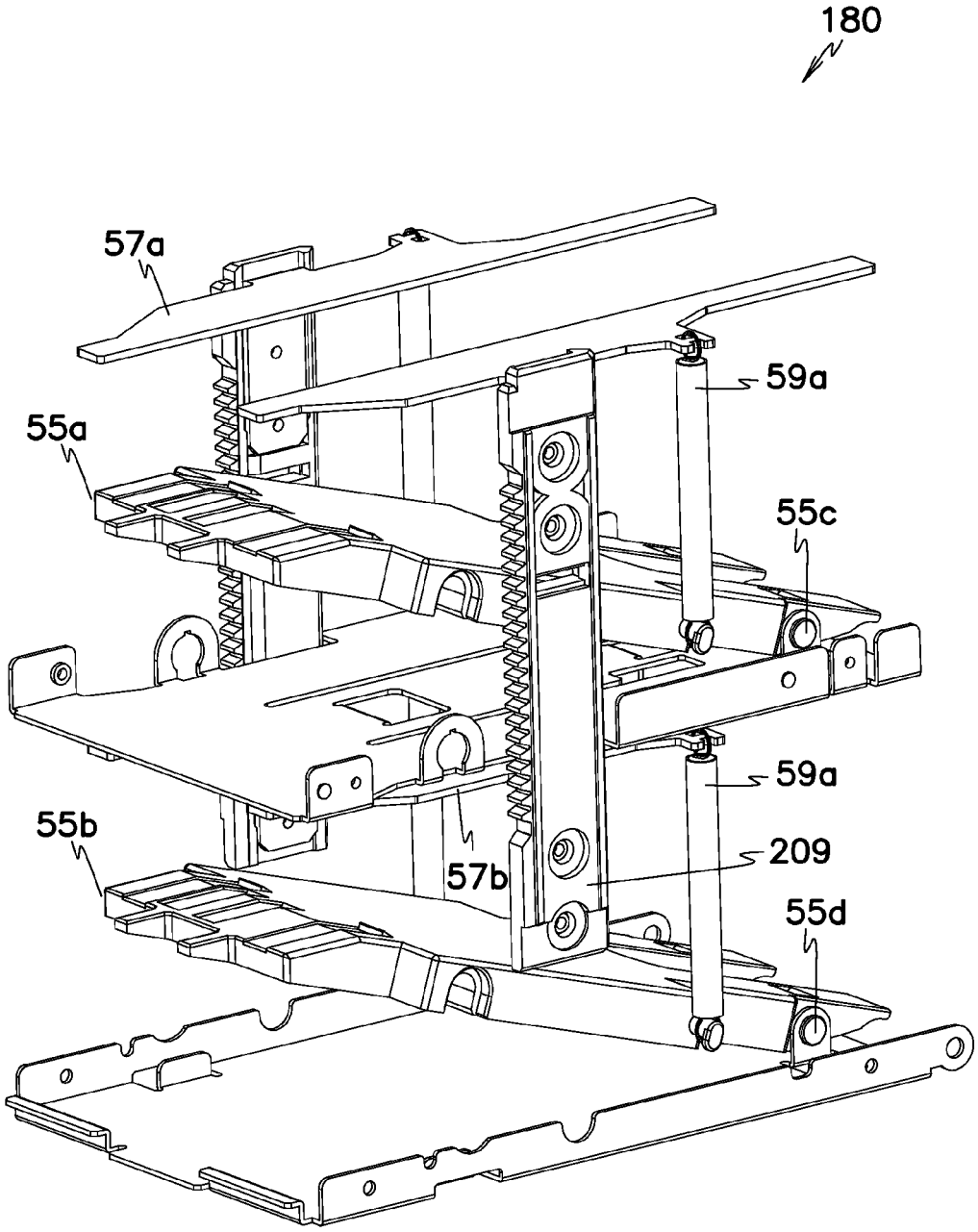
FIG. 22 A perspective view illustrating a slanted bottom plate by operation of the lifter shown in FIG. 20.

FIGS. 20 to 22 depict another embodiment of lifter 180 having its different structure from that shown in FIG. 9. Shown lifter 180 comprises a lifter motor 80 attached to validator 2, a drive gear 210 mounted on an output shaft of lifter motor 80, a rotary encoder 201 integrally rotated with drive gear 210, an encoder sensor 202 for generating electric pulses during rotation of rotary encoder 201, a first follower gear 203 meshed with drive gear 210, a second follower gear 204 mounted at the opposite end on the same shaft of first follower gear 203 for their integral rotation, first, second and third intermediate gears 205, 206 and 207 interlocking second follower gear 204 in series, a lifter pinion 208 meshed with a third intermediate gear 207, and a rack gear 209 meshed with lifter pinion 208 and vertically movable during rotation of lifter pinion 208. First intermediate gear 205 is releaseably meshed with second follower gear 204 so that first intermediate gear 205 is automatically drivingly engaged with or disengaged from second follower 204 when storage 50 is attached to or removed from validator 2. In a similar manner to movement of upper and lower support plates 57*a*, 57*b* shown in FIG. 9, upper and lower support plates 57*a*, 57*b* may move between the lower position shown in FIG. 21 and the upper position shown in FIG. 22 to stow or discharge bills on upper or lower support plate 57*a* or 57*b*. In synchronization with upward and downward movement of upper and lower support plates 57*a*, 57*b*, upper and lower bottom plates 55*a* and 55*b* may be rotated between the horizontal and aslope conditions so that each uppermost bill stored in upper and lower stackers 31, 32 is in contact to corresponding feed rollers 33 when upper and lower bottom plates 55*a*, 55*b* are in the aslope condition at the ready for discharge of bills from upper and lower stackers 31, 32. Then, as shown in FIG. 16, simultaneous adverse rotations of upper and lower feed and delivery rollers 33*a*, 33*b*, 34*a* and 34*b* cause bills to be discharged from upper and lower stackers 31 and 32 to main passageway 6. Control device 200 may receive and count pulses from rotary encoder 201 so that control device 200 may stop operation of lifter motor 80 at the desired number of pulses to stop upper and lower support plates 57*a*, 57*b* at the desired position or may drive lifter motor 80 in the forward or adverse direction to move upper and lower support plates 57*a*, 57*b* in the upward or downward directions.

The foregoing embodiments exemplify the conveyance structure for carrying bills along main passageway 6 by means of main conveyor belt 40, however, in lieu of or in addition to main conveyor belt 40, the embodiment may use combined main conveyor rollers and feed rollers and/or pinch rollers to carry bills along main passageway 6.

APPLICABILITY IN INDUSTRY

While the foregoing description exemplifies the embodiments of the present invention applied to the bill validating/stacking/dispensing device, the invention is also applicable to any device for accepting and/or dispensing bills for bill handling apparatus such as bill validator, discriminator or acceptor or coupon acceptor.

The invention claimed is:

1. A document handler comprising a validator (2), a stacker (3) provided with a storage (50) removably attached to the validator (2), and a main conveyor (4) attached to the validator (2) for transporting a document along a main passageway (6) formed between the validator (2) and stacker (3), wherein the stacker (3) further comprises a storage conveyor (5) for stowing into the storage (50) documents supplied from the validator (2) through the main conveyor (4) and also for extracting one by one documents stored in the storage (50), a deflection lever (38) movable between an opened position for guiding the document transported between the storage (50) and main passageway (6) and an closed position for blocking passage of the document between the storage (50) and main passageway (6), and an actuator (250) for moving the deflection lever (38) between the opened and closed positions, the main conveyor (4) comprises a reversible motor (70) for driving the storage conveyor (5) in the stacker (3), the storage (50) may be removed from the validator (2) by releasing a driving connection between the storage conveyor (5) and reversible motor (70).

2. The document handler of claim 1, wherein the storage conveyor (5) comprises at least one feed roller (33) for putting the document in the storage (50) from the main passageway (6) and also for discharging the document from the storage (50) into the main passageway (6), and at least one delivery roller (34) for picking out the document from the storage (50) into the main passageway (6), the feed and delivery rollers (33, 34) are drivingly and removably connected to the reversible motor (70).

3. The document handler of claim 2, wherein the main conveyor (4) comprises a main conveyor belt (40) or a main conveyor roller arranged along the main passageway (6), the feed roller (33) rotatably supported in the storage conveyor (5) and arranged along the main passageway (6) is automatically brought into contact to the main conveyor belt (40) or main conveyor roller when the stacker (3) is attached to the validator (2), the document transported from the validator (2) is grasped between the main conveyor belt (40) or main conveyor roller and feed roller (33) to carry the document along the main passageway (6), the feed roller (33) is released from contact to the main conveyor belt (40) or main conveyor roller when the stacker (3) is removed from the validator (2).

4. The document handler of claim 3, wherein the storage (50) comprises a pinch roller (49) rotatably mounted and arranged along the main passageway (6), the pinch roller (49) is automatically brought into contact to the main conveyor belt (40) or main conveyor roller when the stacker (3) is attached to the validator (2), the document transported from the validator (2) is grasped between the main conveyor belt (40) or main conveyor roller and pinch roller (49) to carry the document along the main passageway (6), the pinch roller (49) is released from contact to the main conveyor belt (40) or main conveyor roller when the stacker (3) is removed from the validator (2).

5. The document handler of claim 1, wherein the validator (2) comprises a validation conveyor (22) for carrying along a validation passageway (22*a*) the document inserted through an inlet (20) provided in the validator (2), the main conveyor (4) carries the document conveyed along the validation passageway (22*a*) along the main passageway (6) to the stacker (3), the storage conveyor (5) carries the document conveyed along the main passageway (6) into the storage (50) in the stacker (3) when the reversible motor (70) is rotated in one direction.

6. The document handler of claim 5, wherein the storage conveyor (5) extracts the document from the storage (50) to the main passageway (6) when the reversible motor (70) is rotated in another direction, the main conveyor (4) carries the document extracted to the main passageway (6) to the validation passageway (22*a*), the validation conveyor (22) carries the document sent to the validation passageway (22*a*) to the inlet (20).

7. The document handler of claim 5, wherein the stacker (3) comprises a container (51) arranged in a vertically spaced relation to the storage (50) for receiving the documents sent along the main passageway (6) by the main conveyor (4) to accumulate the documents in the container (51) in the non-recyclable condition.

8. The document handler of claim 7, wherein the storage (50) comprises at least one support plate (57) disposed in an upper position of a storage space (31*a*, 32*a*) for receiving the documents, at least one bottom plate (55) movable between a contact position for allowing contact of the document to the delivery roller (34) and a release position for keeping the document away from the delivery roller (34) under the support plate (57), and a lifter (180) for moving the bottom plate (55) from the release position to the contact position to bring the document within the storage space (31*a*, 32*a*) into contact to the delivery roller (34), the delivery roller (34) is rotated to move the document in contact to the delivery roller (34) from under the support plate (57) into the main passageway (6).

9. The document handler of claim 8, wherein the lifter (180) comprises a lifter motor (80) and a rod (83) vertically movable by operation of the lifter motor (80) and drivingly connected to the support plate (57), the vertical movement of the rod (83) causes the document supported on the support plate (57) to be stowed in the storage (50) and also causes the bottom plate (55) to be moved to the contact position to bring the document into contact to the delivery roller (34).

10. The document handler of claim 8, wherein the lifter (180) comprises a lifter motor (80), a lifter pinion (208) rotated by the lifter motor (80) and a rack gear (209) drivingly connected to the support plate (57) and meshed with the lifter pinion (208) to be vertically moved during rotation of the lifter pinion (208), the vertical movement of the rack gear (209) causes the document supported on the support plate (57) to be stowed in the storage (50) and also causes the bottom plate (55) to be moved to the contact position to bring the document into contact to the delivery roller (34).

11. The document handler of claim 1, wherein the storage conveyor (5) comprises a follower gear (35) drivingly and separably connected to a drive gear (76) driven by the reversible motor (70) in the main conveyor (4), a main conveyor belt (40) or main conveyor roller provided in the main conveyor (4), a feed roller (33) automatically brought into contact to the main conveyor belt (40) or main conveyor roller and driven by the follower gear (35) to move the document within the storage (50) when the stacker (3) is attached to the validator (2), and a delivery roller (34) for picking out the document from the storage (50) into the main passageway (6), the feed and delivery rollers (33, 34) are rotated by operation of the reversible motor (70) via the drive and follower gears (76, 35).

12. The document handler of claim 1, wherein the document is transported from the validation passageway (22*a*) in the validator (2) to the main passageway (6) during the forward rotation of the conveyor motor (23), and the feed and delivery rollers (33, 34) are rotated in their forward rotation during the forward rotation of the reversible motor (70) to transport the document from the main passageway (6) to the storage (50).

13. The document handler of claim 12, wherein the delivery and feed rollers (34, 33) are rotated in their adverse rotation during the adverse rotation of the reversible motor (70) to pick out the document from the storage (50) to the main passageway (6), and the document is transported from the main passageway (6) to the validation passageway (22*a*) in the validator (2) during the adverse rotation of the conveyor motor (23).

* * * * *